US012252660B2

(12) United States Patent
Smith

(10) Patent No.: US 12,252,660 B2
(45) Date of Patent: Mar. 18, 2025

(54) MATERIALS RELEASE AGENTS, METHODS OF MAKING AND USING

(71) Applicant: Forrest Walker Smith, Billings, MT (US)

(72) Inventor: Forrest Walker Smith, Billings, MT (US)

( * ) Notice: Subject to any disclaimer, the term of this patent is extended or adjusted under 35 U.S.C. 154(b) by 0 days.

(21) Appl. No.: 18/473,122

(22) Filed: Sep. 22, 2023

(65) Prior Publication Data

US 2024/0101921 A1 Mar. 28, 2024

Related U.S. Application Data

(63) Continuation-in-part of application No. 17/952,086, filed on Sep. 23, 2022, now abandoned.

(51) Int. Cl.

| | |
|---|---|
| ***C10M 129/93*** | (2006.01) |
| ***C10M 141/02*** | (2006.01) |
| ***C10M 169/04*** | (2006.01) |
| ***C10N 40/36*** | (2006.01) |

(52) U.S. Cl.

CPC ..... *C10M 129/93* (2013.01); *C10M 141/02* (2013.01); *C10M 169/04* (2013.01); *C10M 2203/003* (2013.01); *C10M 2207/125* (2013.01); *C10N 2040/36* (2013.01)

(58) Field of Classification Search

CPC ..... C10M 129/93; C10M 141/02; C10M 169/04; C10M 2203/003; C10M 2207/125; C10M 2207/129; C10M 2209/108; C10N 2010/04; C10N 2030/02; C10N 2030/06; C10N 2040/36

See application file for complete search history.

(56) References Cited

U.S. PATENT DOCUMENTS

| | | | |
|---|---|---|---|
| 4,154,750 | A | 5/1979 | Moore |
| 5,494,502 | A | 2/1996 | DeLong |
| 5,837,272 | A | 11/1998 | Fierro, Jr. |
| 6,022,833 | A | 2/2000 | Mueller |
| 6,218,348 | B1 | 4/2001 | Aronson |
| 6,485,651 | B1 | 11/2002 | Branning |
| 6,811,810 | B2 | 11/2004 | LaFay |
| 6,902,606 | B1 | 6/2005 | Davies |

(Continued)

FOREIGN PATENT DOCUMENTS

| | | | | |
|---|---|---|---|---|
| CN | 107849480 | B | 3/2021 | |
| KR | 20140109723 | A | 9/2014 | |
| WO | WO-2017173484 | A1 * | 10/2017 | ..... A23D 7/0053 |

OTHER PUBLICATIONS

Ryan, David Jonathan; Investigation of Fluid Dynamics and Emulsification in Sonolator Liquid Whistles; Thesis; Feb. 2015; University of Birmingham, United Kingdom.

(Continued)

*Primary Examiner* — James C Goloboy

(74) *Attorney, Agent, or Firm* — Nathaniel A. Wickliffe; The Inventor's Friend Patent Law Firm, P.L.L.C.

(57) ABSTRACT

A release agent and method of use for preventing the adhesion of materials to equipment in various industries including construction, mining, and asphalt. The release agent can include oil, surfactant, and in increased level of free fatty acids that can combine with alkali and/or alkaline earth metals in the materials to form a metal/fatty acid salt that prevents adhesion and material build up.

20 Claims, 2 Drawing Sheets

(56) References Cited

U.S. PATENT DOCUMENTS

| | | | |
|---|---|---|---|
| 8,322,910 | B2 | 12/2012 | Gansmuller |
| 8,748,360 | B2 | 6/2014 | Theyssen |
| 9,346,976 | B2 | 5/2016 | Davies |
| 11,090,700 | B1 | 8/2021 | Camell |
| 2003/0176302 | A1 | 9/2003 | Li |
| 2006/0018968 | A1 | 1/2006 | Melbouci |
| 2006/0270569 | A1 | 11/2006 | Athans |
| 2008/0026954 | A1 | 1/2008 | Wu |
| 2008/0217064 | A1 | 9/2008 | Stoian |
| 2009/0145459 | A1 | 6/2009 | Gonzales |
| 2014/0251440 | A1 | 9/2014 | Morrison |
| 2018/0187124 | A1 | 7/2018 | Svriz Viale |

OTHER PUBLICATIONS

BASF Lutensol Surfactants Products Guide (available online Mar. 2019) (Year: 2019).
Dowanol DPM glycol Ether SOS 2019 (Year: 2019).

* cited by examiner

MATERIALS RELEASE AGENTS, METHODS OF MAKING AND USING

FIELD OF THE INVENTION

This application relates to the mining and construction industries, and more particularly, to the release of materials from equipment in the mining and construction industries.

BACKGROUND OF THE INVENTION

The amount of nonvalue added activities that are required for finished pavement and buildings is a constant source of cost. The mining and construction industries related to mining materials, aggregate, asphalt, and concrete i.e., "paveables" spends a disproportionate amount of effort in the removal of material buildup from equipment. The mining and construction industries are constantly presented with how to more efficiently locate and process valuable materials from source to destination. A major factor adding to the difficulty in this task is that the desired materials and ore are almost always buried beneath non-valuable material that must first be removed and carried away from the dig site. "Overburden" is the general label for the non-valuable materials at the mine commonly consisting of wet sand, mud, clay, and the like (or a combination thereof) which is very heavy and tends to stick to mining equipment. Additionally, materials that typically require processing and then final delivery to a construction site cling to equipment and accumulate. Final product adhesion such as asphalt and concrete are more problematic when it adheres to equipment resulting in lost material and loads costs associated with proper removal and waste processing. This equipment can be any device coming in contact with the materials from large vehicles to hand tools and other implements.

In some situations, such as in high altitude or arctic mining operations, the mining material (both overburden and the targeted minerals) may freeze to the mining equipment. This scenario is particularly common in cold weather mining operations in which mined material will freeze to equipment during transport. Mining material is extracted using one piece of equipment (such as an excavator), transferred using another (such as a front-end loader) and transported using other equipment (such as heavy trucks, carts, or trains), and finally processed using yet another set of equipment. At each step of the process, the mining material—including the valuable minerals/ore being mined—can build up on the equipment. This build up is a problem in that it interferes with the normal operation of the equipment, in the case of ore or targeted minerals being accumulated on the equipment, resulting in a loss of profitable material.

This problem also occurs on the delivery and installation of finished materials as well such as asphalt and concrete. Concrete can build up on the inside of trucks and other equipment, adding to the inside of the equipment layer by layer until the capacity of the equipment is significantly reduced. Buildup of material on equipment thus adds to the cost of processing because it adds labor and delay in the form of extra maintenance and cleaning costs, lost product, and additional man-hours. Additionally, the interference of buildup to the normal operations of the equipment mentioned in the mining, asphalt, and concrete industries inevitably causes reductions to the volume capacity of the equipment making them less efficient adding operational costs that directly lead to increased profit loss. Various material release agents are often used in industries such as the concrete, mining, and asphalt industries to prevent these materials from adhering to the equipment.

A number of prior art release agents, such as the one described in U.S. Pat. No. 6,902,606, incorporate water. As described above, mining operations often take place in cold temperatures, which makes freezing a problem. And, even when the temperature is not freezing, the overburden often will have a high-water content, which causes much of the sticking. Thus, the presence of water in the prior art products would often serve to amplify the freezing and sticking problems that the release agent is intended to solve. Furthermore, contact with water, such as an aqueous materials release agent, can have a detrimental effect on the concrete, and on its ability to cure, potentially resulting in catastrophic failure of concrete structures.

Similarly, many prior art products incorporate yellow grease or tallow as part of the release agent, which may also contain impurities which will work to contaminate the material or clog the application equipment. This is relevant both to the mining application processes where the refinement will incur additional effort, and the finished materials trade where the impurities may affect the cured material properties, such as weakening the cured concrete. In addition to the problematic prior art release agents that incorporate grease or tallow, various prior art lubricants also incorporate grease or tallow, however, it should be clear that anti-sticking agents (also referred to as materials release agents) differ from lubricants. Lubricants are designed to reduce friction between any two surfaces and dissipate heat generated by friction, however, lubricants, and especially lubricants based in grease or tallow are particularly unsuited to the function of a materials release agent to reduce the inherently adhesive qualities of a given compound.

Prior art products used for different applications in other industries often incorporate compounds that are undesirable or problematic such as phosphate esters or ethoxylated carboxylic acid. Such unacceptable components would drastically diminish or destroy a product's ability to function as a materials release agent, and potentially have a negative effect on the construction or mining process, the material being processed, or negatively affect the environment. A wide range of impurities, including but not limited to, phosphate esters and ethoxylated carboxylic acids can have a detrimental effect on the strength of the concrete potentially resulting in catastrophic failure of any concrete that has come into contact with such impurities before the concrete hardens.

Furthermore, prior art products have characteristics that are undesirable like separation of the ingredients and short shelf life. It is an object of this invention to provide an adhesion resistant coating for use in the mining and construction industries to help alleviate the problems associated with material adhesion buildup, while also being non-toxic, having a low freezing point and a high boiling point and a long shelf life without separation of the constituents of the materials release agent.

SUMMARY OF THE INVENTION

This disclosure overcomes disadvantages of the prior art by providing a material release agent suitable for use in the mining and material processing industries. In particular, the liquid coating described herein can be applied to equipment to prevent materials from sticking or freezing to the equipment. The material release agent can be a fluid that incorporates Free Fatty Acids (FFAs), oils, and a surfactant dispersing agent in a new product that has properties desirable for use in the mining industry and material processing industries such as the cement and asphalt industries. The present disclosure represents an improvement over the prior art in that it is a super emulsion that provides a more stable, efficient, biodegradable non-adhesion coating for use in the mining and construction industries, without the negative properties found in prior art products.

Additionally, the materials release agent emulsion described herein no longer needs any of the prior art additives, and is not susceptible to absorption of free water from exposure to atmospheric humidity. The materials release agent described herein contains no water and is subject to absorbing no more than 0.01% water from atmospheric humidity, delivering a 99.99% anhydrous product for the materials industries. The materials release agent described herein contains Free Fatty Acids (FFAs), triglycerides, partially hydrolyzed triglycerides that can include diglycerides and potentially monoglycerides, and a surfactant. The materials release agent is a product of three (3) starting ingredients: a natural oil, a surfactant dispersing agent, and water, however, the water initially added at the beginning of the mixing and manufacturing process is entirely consumed by hydrolysis, which results in the release of FFAs. This process whereby the water is entirely consumed by hydrolysis can create an anhydrous and nonpolar liquid, which can also be referred to as an organic or oil phase liquid, or a nonaqueous liquid.

It is an object of this disclosure to provide an industrial fluid made from non-hazardous, biodegradable materials that prevents or substantially lessens instances of material sticking or freezing to mineral mining processing equipment and/or instances of unwanted buildup of concrete or asphalt on equipment used for those paveables. An additional benefit found in this invention is that it uses relatively low-cost materials that have desirable physical and chemical properties, as described below. These desirable properties stand in stark contrast to prior art products.

In an embodiment for use in the concrete industry, a fluid for use in reducing adhesion of material to equipment, also referred to as a materials release agent, can include Free Fatty Acids (FFAs) in a percentage by weight in a range between approximately 2% and approximately 17%. In various embodiments, the materials release agent can include FFAs in a percentage by weight in a range between approximately 2% and approximately 35%. In an embodiment, the materials release agent can include FFAs in a percentage by weight of approximately 8.3%. In an embodiment, a material release agent can include a surfactant in a percentage by weight in a range between approximately 3% and approximately 25%. In various embodiments, the surfactant can be in a percentage by weight of approximately 5% to approximately 10%. In various embodiments, the surfactant can be a branched alcohol ethoxylate. In various embodiments, the fluid can include water in a percentage by weight of approximately 0.05% or less. In various embodiments, the fluid can have a freezing point lower than 25° F. The fluid can have a shelf life of at least 24 months. The fluid has a dynamic viscosity between approximately 52 cP and approximately 55 cP at 75° F. The fluid has a dynamic viscosity of approximately 55 cP at 75° F. The fluid mixture can have a density between 7.55 lbs/gal and 7.60 lbs/gal (approx. 0.905 g/mL and 0.910 g/mL) at 75° F.

The term oil remainders can be used herein to refer to what becomes of the oil after a portion of the oil has been hydrolyzed to release the FFAs, explained more fully below. A portion of the triglycerides can be partially hydrolyzed resulting in an oil remainder that includes triglycerides, diglycerides, and possibly a small about of monoglycerides. After the hydrolysis process described herein to produce the material release agent, the oil remainders can make up a percentage of the materials release agent by weight in a range of approximately 60% to approximately 95%.

In various embodiments, a materials release agent for use in reducing adhesion of material to equipment can include FFAs in a percentage by weight in a range of approximately 2% to approximately 17%, surfactant in a percentage by weight of approximately 3% to approximately 25%, and oil remainders in a percentage by weight of approximately 60% to approximately 95%.

The materials release agent can be non-polar. The materials release agent can be anhydrous. The materials release agent can have a freezing point lower than 25° F.; The materials release agent can have surfactant is in a percentage by weight of approximately 5% to approximately 10%. The percentage by weight of the FFAs, the surfactant, and the oil remainders can be at least 95%. The percentage by weight of the FFAs, the surfactant, and the oil reminders can be at least 99%. The materials release agent can have a shelf life of at least 12 months. The materials release agent can have a viscosity between approximately 90 and approximately 95 cP. The materials release agent can have a density between 7.55 lbs/gal and 7.60 lbs/gal. The materials release agent can have a pH in a range between approximately 6.0 pH and approximately 6.8 pH. The materials release agent can have a pH in a range between approximately 6.4 pH and approximately 6.8 pH. The materials release agent can be water insoluble. The materials release agent can be free of phosphorus, nitrogen, phospholipids, amino acids, oxides, benzenes, triester phosphates, amines, inorganic acids, petroleum lubricants, synthetic oils, alkyl ether carboxylic acid, polyethylene terephthalic acid, phosphoric acid esters, neutralizing agents, phosphate esters, amino alcohols, phosphate esters, amino alcohols, phosphate esters, polyalphaolefins, and antioxidants.

A method for protecting a surface from material adhesion can include coating the surface with a material release agent, wherein the material release agent includes oil remainders in a percentage by weight of approximately 60% to approximately 95%, surfactant in a percentage by weight of approximately 3% to approximately 25%, and FFAs in a percentage by weight of approximately 2% to approximately 17%.

BRIEF DESCRIPTION OF THE DRAWINGS

The invention description below refers to the accompanying drawings, of which.

DETAILED DESCRIPTION

Figure 1:
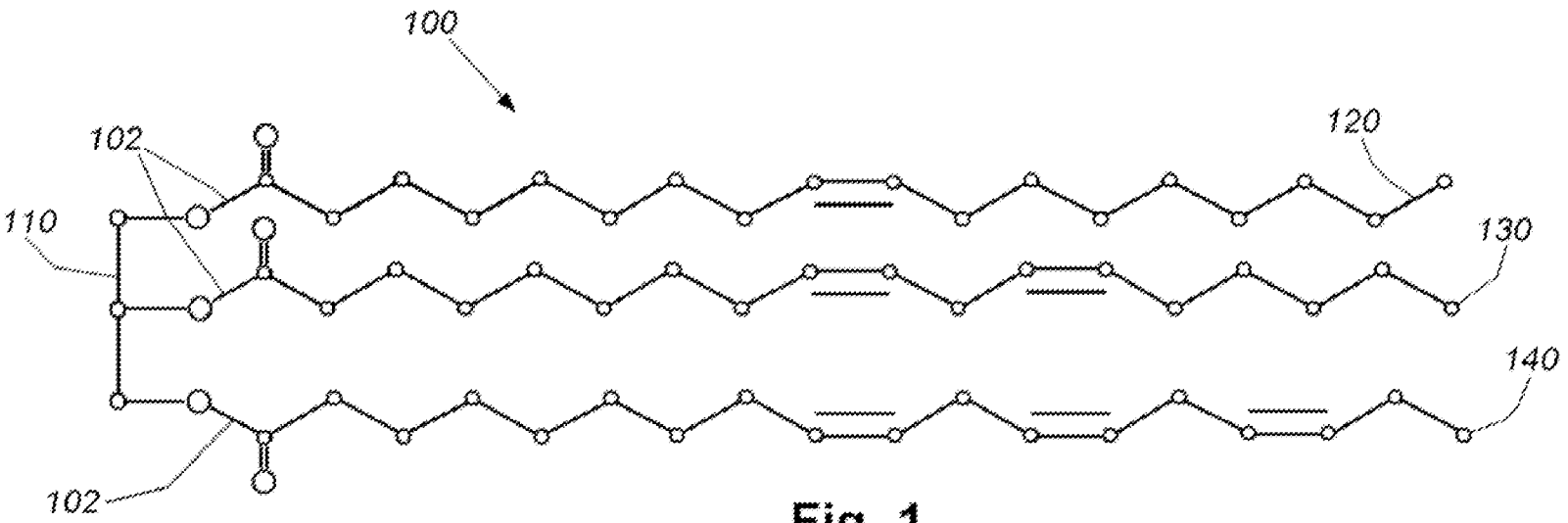
FIG. 1 is a chemical diagram showing an exemplary triglyceride, according to an illustrative embodiment.

The following description includes several exemplary embodiments of a release agent, along with methods of manufacture and usage. Throughout this description, the release agent can also be referred to as a materials release agent or a build-up prevention agent. It is also to be understood that multiple embodiments of the release agent are possible and structural and functional changes may be made without departing from the scope of the present product. Generally, the product as described herein is intended to be used as such without any additional treatment steps, such as dilution, etc. Whenever a concentration of a component in a composition is given in percentages, it is meant to be weight percentage unless it explicitly states otherwise.

The material release agent described herein is an industrial process fluid suitable for use as a coating in the mining and material processing industries. More particularly, the liquid can be a fluid mixture that can be applied to mining equipment and material processing equipment for the purpose of reducing the inherently adhesive nature of the materials to adhere to the equipment, thereby preventing the materials from sticking to the equipment during operation. As used in this description, "materials" refers to ore, ore concentrate, coal, clay, mud, aggregates, cement, concrete, asphalt, and other materials of the kind that are commonly encountered during mining operations to extract raw materials, or as finished products used for building and paving. "Equipment" refers to equipment used in mining, material processing, and construction operations, including haul truck trays, truck undercarriages, rail cars, earthmoving equipment (scoop trams, excavators, loaders, shovels, etc.), tracked vehicles, chutes, conveyors, mixers, trommels, cement trucks, wash bins, wheel barrows, shovels, lutes, rakes, forms, and the like. The examples used in the above definitions are intended to give a general idea of the terms and are not intended to limit the definitions to only those specific examples. There are other types of mining materials or equipment that are relevant to this invention that are not included in the illustrative list provided here such as work boots. This materials release agent sprayed on work boots prevents cement from caking onto the footwear stopping the boots from becoming heavier from concrete buildup adhering to the boots and extends the life span of the boots. Other features and advantages of the present invention will become more apparent from the following description of the embodiments.

The material release agent described herein can be used in various industries including construction, mining, cement, and asphalt. Various materials in these industries, including cement, aggregates, asphalts, concrete slurries, and mining materials contain alkali metals (AMs) and/or alkaline earth metals (AEMs). For example, AMs include $Na^+$ and $K^+$ amongst the other metals in that elemental family group, while AEMs include, $Mg^{2+}$, and $Ca^{2+}$ along with the other metals in that elemental family group. As used herein, the word "Metal" and the abbreviation "M" refer to the alkali metals and/or the alkaline earth metals, including but not limited to the alkali metals and/or alkaline earth metals described above.

The material release agent described herein is a nonpolar anhydrous hydrophobic fluid containing various tri-esters (also referred to as triglycerides), Free Fatty Acids (FFAs), and ester alcohols (also referred to as diglycerides and/or monoglycerides). When a surface of any equipment is coated with the material release agent of the invention, the FFAs will react with the metals described above to create a Metal/Fatty Acid (MFA) salt, and the MFA salt can then precipitate out from the fluid. The MFA salt precipitate forms a thin film layer on the applied surface, and that thin film layer inhibits the buildup or adhesion of industrial materials on the surface. Put another way, the Metal Fatty Acid salt precipitate forms a thin layer film barrier that prevents adhesion. The FFAs in the present material release agent react with the various Metal ions in the industrial materials to form a MFA salt precipitate, which can form the thin layer film on the industrial equipment to inhibit adhesion or buildup of the material on the equipment.

Without being bound to any theory, it is also postulated that a significant portion of the composition of the materials release agent are triglycerides (also referred to as tri-esters) which further prevent industrial materials buildup by creating a polar-nonpolar repulsion against the aqueous cement slurry or water saturated overburden, resulting in additional resistance to adhesion. The non-polar material release agent can also repel a polar aqueous cement slurry, thereby further preventing adhesion or material buildup. The MFA salt is also not soluble in water or the aqueous phase of the various materials, and instead the MFA prefers to remain in the organic non-polar oil phase until it precipitates out. Because the polar-non-polar repulsion keeps the MFA out of the aqueous phase, when the MFA precipitates out of solution, it deposits onto the surface forming a thin layer coating, similar to a soap scum, which prevents the concrete or other materials from adhering to the surface. The polar-non-polar repulsion helps to ensure the MFA salt precipitate forms the protective layer on the equipment.

By way of non-limiting example, in various embodiments, the manufacturing of a materials release agent can start with combining a starting mixture of triglycerides, surfactant, and a small amount of water. In various embodiments, the starting mixture can include approximately 94.45% triglycerides, approximately 5% surfactant, and approximately 0.55% total water. The starting mixture can be hydrolyzed to produce a materials release agent, and in various embodiments, the hydrolysis can take place at approximately 100 F and approximately 1800 psi. The water can be entirely consumed by the hydrolysis, resulting in an anhydrous non-polar material release fluid. In various embodiments, the material release agent can be approximately 8% FFAs, approximately 5% surfactant, and approximately 87% oil remainders that can be diglycerides, unhydrolyzed triglycerides, and possibly a small amount of monoglycerides.

Terms such as starting ingredient can refer to an ingredient that is combined together with other ingredients before hydrolysis. Terms such as mixture of starting ingredients, initial starting mixture, starting mixture of raw ingredients, and starting ingredients mixture, as used herein, all refer to the mixture of starting ingredients that are combined before the process of hydrolysis. The mixture of starting ingredients includes a natural, plant-based oil, a surfactant, and water. The water can include water already present in the oil, such as moisture absorbed out of the air, plus added water.

Although it is possible to use many different oils as a starting ingredient, natural oils derived from plants are preferred. The release agent described herein includes an oil that can be one or more natural oils such as plant-based oils that can include soybean oil, peanut oil, rapeseed oil, canola oil, palm oil, coconut oil, corn oil, cottonseed oil, olive oil, sesame oil, sunflower oil, safflower oil and/or vegetable oil. By using natural oils, the end product is non-hazardous and almost 100% biodegradable. In various embodiments, crude degummed soybean oil can be used as a starting ingredient in the process of manufacturing of the release agent. The triglycerides in the soybean oil can react with water through hydrolysis, which results in the release of Free Fatty Acids. The importance of inducing hydrolysis of the soybean oil will be explained below.

The release agent also includes a nonionic surfactant dispersing agent, such as a branched alcohol ethoxylate as a starting ingredient in the process of manufacturing the release agent, however, unlike the water and the oil, the surfactant dispersing agent is not a reactant. The surfactant can be added as a starting ingredient, and remains intact in the resulting materials release agent. A Beta-branched alcohol ethoxylate, such as polyethyleneoxide-8, 2-propylheptanol (Chemical Formula $C_{26}H_{54}O_9$), is preferred because of its exemplary wetting, hygroscopic, and emulsifying dispersing properties for this particular application. An example of this hygroscopic surfactant dispersing agent is T-Det® PX8 which can be purchased from Harcros Chemicals commercially. By mixing an oil such as one of the above-mentioned natural plant-based oils with a wetting agent such as a hygroscopic surfactant dispersing agent, the end product, the materials release agent, is able to spread out across the equipment surface area more efficiently, and maintains consistent product concentration ratios to aid the release of material from the equipment. As the materials release agent thins out across the equipment surface area, consistent ratios of product concentration are maintained across the surface due to the dispersing properties of the Beta-branched alcohol ethoxylate surfactant. Although a beta-branched alcohol ethoxylate can provide the greatest benefit in many applications, in various embodiments, various surfactants having similar or related properties to those listed above may also be suitable for use in this release agent, such as linear alcohol alkoxylates, phenyl alcohols, or esterified glycol polymers. Accordingly, it should be understood that those various surfactants may be within the scope of the release agent disclosed herein.

In various embodiments, the release agent can incorporate various additives, including non-hazardous additives that do not materially alter the nonstick properties of the release agent, as described above. The additives can be a colorant and/or an odorant to impart a pleasant smell or coloring to the product. These additives can be added at or near the end of the manufacturing process, after the oil has been hydrolyzed. By way of non-limiting example, various embodiments might incorporate Jasmin oil to give the fluid a pleasant scent. In another embodiment, the fluid might incorporate green food coloring or other dye to make the fluid stand out visually from other materials used in the mining operation. The examples of additives given here are illustrative, and are not intended to be limiting. The exact amounts of the additives needed to impart the desired functionality will become apparent to one skilled in the art without undue experimentation.

However, impurities such as phosphorus and nitrogen can prevent the material release agent from working because they can react with the fatty acids, essentially neutralizing the fatty acids and creating phospholipids and amino acids. If the FFAs are neutralized in this way, the FFAs cannot react with the metals to produce the MFAs, and without the formation of the MFAs, the materials release agent is rendered ineffective. Furthermore, phospholipids can be problematic because they can undergo hydrolysis, effectively stealing a portion of the water molecules that should be hydrolyzing the oil to create FFAs. The presence of phospholipids can result in insufficient hydrolysis of the oils and insufficient production of FFAs. Silicone will also inhibit the materials release agent as it will absorb or react with the FFAs, thereby rendering the materials release agent ineffective due to reduced levels of FFAs. Oxides and benzenes can also be problematic for the materials release agent, at least because they are unstable and volatile, and can flash off causing a change in the overall composition and/or can react in various ways resulting in damaging composition change and eliminating or removing components of the materials release agent.

Other contaminants or impurities in the materials release agent that should be avoided can include metal hydroxides such a potassium hydroxides and Sodium hydroxides, ammonia, buffers such as sodium carbonate, potassium carbonate, triester phosphates, amines, inorganic acids, non-aqueous petroleum lubricants, synthetic oils, alkyl ether carboxylic acid, polyethylene terephthalic, phosphoric acid esters, neutralizing agents, phosphate esters, amino alcohols, organic phosphate esters, polyalphaolefins, and antioxidants. Various impurities such as these can cause unwanted reactions during the hydrolyzing and homogenizing process, can compromise the chemistry of the cement, can cause the beta-branched alcohol surfactant to be useless as a surfactant, can ruin the long-term shelf-stable nature of the material release agent, can interfere with the hydrolysis reaction, and/or can neutralize the FFAs that are freed by the hydrolysis.

The fatty acids of the triglycerides must be freed through the process of hydrolysis to become Free Fatty Acids (FFA). The term Free Fatty Acid in connection with the present disclosure means that the acidic functional group (carboxylic group) of the fatty acid is not blocked by, or reacts with, any other component of the material release agent. The material release agent does not contain (is free of) any counter ions which may block and/or react with the carboxylic group of the fatty acids. The material release agent does not contain any cationic ions or other cationic components which may act as a counter ion of the carboxylic group. The FFAs must truly be free, and the materials release agent must be free of any impurities that will act as a counter ion of the carboxylic group of the FFAs.

In various embodiments, Crude Degummed Soybean Oil (CDSBO) can be used as a raw starting ingredient for this process because crude soybean oil has phosphatides which are removed through the degumming process. In addition to phosphatides, the degumming process can remove glycolipids, hydrophilic substances such as sugars, Mg, Ca, and/or Fe ions. In various embodiments, it can be beneficial for the soybean oil to be degummed before being used as a starting ingredient in the manufacture of the release agent so that the impurities do not interfere with the manufacturing and/or use of the release agent. These impurities such as the phosphatides and metals, as well as phosphoric compounds, amines, ethoxylated carboxylic acids, organic distillate residues, various ions, along with heavily dissociating compounds can interfere with the performance of the materials release agent. Degumming the crude soybean oil removes problematic compounds such as phosphates to avoid these problems.

In various embodiments, it can be beneficial for the soybean oil to be crude degummed soybean oil (CDSBO) as opposed to refined bleached deodorized soybean oil. The manufacturing of the materials release agent described herein includes the use of water to hydrolyze the oils in order to release FFAs. The process of refining the soybean oil into refined soybean oil includes removal of water and FFAs, and does so at an additional expense. Because the materials release agent described herein uses water to release FFAs, the higher priced refined oil with the water and FFAs removed can be an unnecessary expense, although it can be used.

The primary molecular structures of CDSBO can be a combination of numerous different triglycerides that can be composed of a variety of different substituent FAs. In various soybean oils, at least about 97% or even greater than 99% of the oil are triglyceride compounds. In some CDSBO, approximately 99.7% of the oil can be triglycerides, with an additional small portion, such as 0.3%, being $H_2O$. Triglyceride compounds (esters) are a glycerol backbone attached to 3 separate saturated or unsaturated aliphatic hydrocarbon chains via a carbonyl group on the hydrocarbon chain. It is known to those skilled in the art that the aliphatic hydrocarbon chain is the fatty portion of the oil. Exemplary fatty acids include, but not limited to, oleic acid, palmitic acid, linoleic acid, stearic acid, linolenic acid, and the like.

The FFAs in the final product material release agent enable the material release agent to form the MFA salts, and the formation of the MFA salts on the surfaces of the equipment results in the materials being easily released from the equipment instead of sticking. However, as they come from their manufacturers, crude soybean oil, crude degummed soybean oil, and refined bleached deodorized (RBD) soybean oil all lack adequate concentration of actual free fatty acids to provide the superior results the release agent described herein achieves. Typical weight concentrations of FFA's in crude soybean oil and crude degummed soybean oil are approximately 0.59% and 0.57% respectively, and lower yet in RBD soybean oil. Any of these oils must be hydrolyzed to result in the final product materials release agent with sufficient levels of FFAs.

Hydrolysis of the triglyceride used as a starting ingredient can be used to increase the concentration of FFAs in the final material release agent. FIG. 1 is a chemical diagram showing an exemplary triglyceride, according to an illustrative embodiment. The triglyceride 100 has a glycerol backbone 110, and three different Fatty Acid (FA) chains bonded to the glycerol backbone 100. The FAs shown in FIG. 1 include an oleic acid 120, a linoleic acid 130, and a linolenic acid 140, however, it should be clear that various FAs are possible with various numbers of carbon atoms and various numbers of double bonds between carbon atoms. A triglyceride can include three of the same FA chain, or various combinations of different FA chains.

Hydrolysis of the triglyceride means that a water molecule is used to separate a FA chain from the glycerol backbone, which results in the release of the Free Fatty Acid (FFA). Through hydrolysis, a hydroxyl group ($OH^-$) from the water bonds to the FA carbonyl group, and the oxygen of the glycerol backbone bonds with a hydronium ion ($H^+$) from the water. Put another way, the hydrolysis involves using a water molecule to break the ester bond 102 of the triglyceride 100. The ester bond 102 is between the oxygen on the glycerol backbone and the carbonyl carbon on the fatty acid chain, and breaking that bond through hydrolysis results in a Free Fatty Acid (FFA) that is no longer attached to the glyceride molecule. Through the process of hydrolysis, one, two, or all three FA chains can be broken off of the glycerol backbone resulting in FFAs. It is these unbonded, or Freed, Fatty Acids that can then form the MFA salts when the release agent is used. Not fully refined soybean oil degummed of phosphatides is an excellent raw material that can be hydrolyzed to release the FFAs that enable the desired performance of the release agent. As used herein, not fully refined soybean oil degummed of phosphatides can also be referred to as Crude Degummed Soybean Oil, or CDSBO. In various embodiments, CDSBO is the preferred oil for use as a starting ingredient, or put another way, CDSBO is the preferred oil for use as a reagent in the manufacture of the release agent.

CDSBO can contain trace amounts of water, such as 0.3%. The trace amounts of water contained in the CDSBO along with the water added during the manufacturing of the final product provides the source of $H^+$ ions and $OH^-$ ions required for hydrolysis. The hydrolysis of the Triglycerides in the CDSBO is kinetically favored, but thermodynamically driven. Due to the trace amounts of water in the CDSBO (such as 0.3% from the OPM), and atmospheric humidity, hydrolysis may occur over time at ambient temperatures; however, when the CDSBO is heated and processed through the manufacturing equipment, hydrolysis occurs at an accelerated rate. The water added in the manufacturing process, plus any additional moisture present in the CDSBO from the supplier, allow for additional hydrolysis when the combined ingredients are passed through the manufacturing equipment, explained more fully below. By way of non-limiting example, the natural plant-based CDSBO can be comprised of 99.7% triglycerides and 0.3% water, however, the exact amount of water in the CDSBO or other oils may vary based on the quality levels of different manufacturers and environmental conditions.

Hydrolysis is accelerated/influenced by thermal energy, which can be created by thermal and mechanical actions through two (2) different methods: organic chemical reactions and mechanochemical physically influenced shearing forces. Hydrolysis of the CDSBO increases the Freed Fatty Acids (FFA) concentration; however, the extent of Hydrolysis is limited by the amount of $H_2O$ present in the initial starting ingredients, including $H_2O$ absorbed through ambient humidity conditions and added water. That is to say, water is the limiting reagent in the initial starting mixture of oil, water, and surfactant. The water is consumed through the hydrolysis, resulting in an anhydrous materials release agent.

In various embodiments, the initial mixture of starting ingredients before hydrolysis can include an oil such as crude degummed soybean oil, a surfactant, and a small amount of water provided to drive the hydrolysis. The specific ratios of the raw starting ingredients can vary depending on the application. By way of non-limiting example, in various embodiments, a release agent for a cement industry may benefit from a final materials release agent with fewer FFAs as greater concentrations of FFAs may have a harmful effect on concrete, while a release agent for the mining or asphalt industries may be more effective with more FFAs relative to the release agent for the cement industry. In various other usages, industries, and/or methods of application, increased quantities of FFAs may increase the non-adhesive properties of the release agent. The ratios of the ingredients in the initial starting mixture can directly affect the amount of FFAs in the final product material release agent, and different ratios of starting ingredients, leading to different amounts of FFAs in the final product, can be beneficial in different industries.

The quantity of total water used as a raw starting ingredient can directly affect the amount of FFAs in the final product release agent. In various embodiments that can be used in concrete, mining, and/or asphalt industries, the total amount of water present in the mixture of raw starting ingredients can be approximately 0.55%. One skilled in the art would understand that the total amount of water in the release agent may be brought to the specific concentrations using known techniques in the art. For example, when the raw starting ingredient used in the release agent is CDSBO, and the amount of water present in it is 0.3% as it is obtained from a manufacturer, then an additional 0.25% water is added to bring the final concentration of water in the release agent to 0.55%. Similarly, if the CDSBO has a greater concentration of water, say 0.8%, then the excess water can be removed through known means such as evaporation under reduced pressure, use of dehydrating agents such as molecular sieves, and the like.

However, it should be noted that the amount of moisture present in the CDSBO as it arrives from the manufacturer can typically vary in a range between approximately 0.0% and approximately 0.3%. In various embodiments designed for use in the concrete industry, the total water present in the mixture of raw starting ingredients can be in a range between approximately 0.25% and approximately 1.3%. Accordingly, in various embodiments designed for use in the concrete industry, the additional water added to the mixture can be in a range between approximately 0% and approximately 1.3%, thereby resulting in the desired total water present in the mixture of starting ingredients in a range between approximately 0.25% and 1.3%.

In various embodiments designed for use in industries other than the concrete industry, such as mining or asphalt, the total amount of water present in the mixture of raw starting ingredients can be as high as approximately 3.3%, because the additional FFAs that result from the additional hydrolysis can help to further prevent adhesion and do not have the same negative side effects that may come with an excess of FFAs in the cement industry. The additional FFAs can lead to the formation of additional MFAs, which can further limit adhesion in industries such as asphalt and mining.

However, as noted above, the amount of water added as a separate reagent can be less than the total amount of water present in the mixture of raw starting ingredients, due to water that may have already been present in the CDSBO. By way of non-limiting example, CDSBO can start with approximately 0.3% water in the oil as it arrives from the oil manufacturer, which would mean that in that case, up to approximately 3.0% or more water can be added to the mixture of raw starting ingredients to reach 3.3% total water in the mixture. In various embodiments designed for use in industries such as asphalt and mining, the water added to the mixture separately, in addition to any moisture also present in the oil, can be in a range between approximately 1.0% and approximately 3.3%. In various embodiments designed for use in industries such as asphalt and mining, the total water present in the mixture of raw starting ingredients can be in a range between approximately 1.3% and approximately 3.3%

As noted above, total water in the mixture of starting ingredients can include any water already present in the CDSBO plus the added water. In various embodiments designed for use in the concrete industry, the mixture of raw starting ingredients can include total water that can be approximately 0.55% of the mixture, including water present in the oil plus added water. However, in various embodiments for the concrete industry, different levels of total water in the mixture of starting ingredients can be beneficial, resulting in different levels of FFAs in the materials release agent. In various embodiments for the concrete industry, the total water can be a percentage of the mixture of raw ingredients that can be in a range between approximately 0.25% and approximately 1.3%. In various embodiments for use in the concrete industry, the minimum percentage of total water in the mixture of starting ingredients can be approximately 0.25%. In various embodiments for use in the concrete industry, the minimum percentage of total water in the mixture of starting ingredients can be approximately 0.30%. In various embodiments for use in the concrete industry, the minimum percentage of total water in the mixture of starting ingredients can be approximately 0.35%. In various embodiments for use in the concrete industry, the minimum percentage of total water in the mixture of starting ingredients can be approximately 0.40%. In various embodiments for use in the concrete industry, the minimum percentage of total water in the mixture of starting ingredients can be approximately 0.45%. In various embodiments for use in the concrete industry, the minimum percentage of total water in the mixture of starting ingredients can be approximately 0.50%. In various embodiments for use in the concrete industry, the minimum percentage of total water in the mixture of starting ingredients can be approximately 0.55%. In various embodiments for use in the concrete industry, the minimum percentage of total water in the mixture of starting ingredients can be approximately 0.60%. In various embodiments for use in the concrete industry, the minimum percentage of total water in the mixture of starting ingredients can be approximately 0.65%. In various embodiments for use in the concrete industry, the minimum percentage of total water in the mixture of starting ingredients can be approximately 0.70%. In various embodiments for use in the concrete industry, the minimum percentage of total water in the mixture of starting ingredients can be approximately 0.75%. In various embodiments for use in the concrete industry, the minimum percentage of total water in the mixture of starting ingredients can be approximately 0.80%. In various embodiments for use in the concrete industry, the minimum percentage of total water in the mixture of starting ingredients can be approximately 0.85%. In various embodiments for use in the concrete industry, the minimum percentage of total water in the mixture of starting ingredients can be approximately 0.90%. In various embodiments for use in the concrete industry, the minimum percentage of total water in the mixture of starting ingredients can be approximately 0.95%. In various embodiments for use in the concrete industry, the minimum percentage of total water in the mixture of starting ingredients can be approximately 1.00%. In various embodiments for use in the concrete industry, the minimum percentage of total water in the mixture of starting ingredients can be approximately 1.05%. In various embodiments for use in the concrete industry, the minimum percentage of total water in the mixture of starting ingredients can be approximately 1.10%. In various embodiments for use in the concrete industry, the minimum percentage of total water in the mixture of starting ingredients can be approximately 1.15%. In various embodiments for use in the concrete industry, the minimum percentage of total water in the mixture of starting ingredients can be approximately 1.20%. In various embodiments for use in the concrete industry, the minimum percentage of total water in the mixture of starting ingredients can be approximately 1.25%.

In various embodiments for use in the concrete industry, the maximum percentage of total water in the mixture of starting ingredients can be approximately 1.30%. In various embodiments for use in the concrete industry, the maximum percentage of total water in the mixture of starting ingredients can be approximately 1.25%. In various embodiments for use in the concrete industry, the maximum percentage of total water in the mixture of starting ingredients can be approximately 1.20%. In various embodiments for use in the concrete industry, the maximum percentage of total water in the mixture of starting ingredients can be approximately 1.15%. In various embodiments for use in the concrete industry, the maximum percentage of total water in the mixture of starting ingredients can be approximately 1.10%. In various embodiments for use in the concrete industry, the maximum percentage of total water in the mixture of starting ingredients can be approximately 1.05%. In various embodiments for use in the concrete industry, the maximum percentage of total water in the mixture of starting ingredients can be approximately 1.00%. In various embodiments for use in the concrete industry, the maximum percentage of total water in the mixture of starting ingredients can be approximately 0.95%. In various embodiments for use in the concrete industry, the maximum percentage of total water in the mixture of starting ingredients can be approximately 0.90%. In various embodiments for use in the concrete industry, the maximum percentage of total water in the mixture of starting ingredients can be approximately 0.85%. In various embodiments for use in the concrete industry, the maximum percentage of total water in the mixture of starting ingredients can be approximately 0.80%. In various embodiments for use in the concrete industry, the maximum percentage of total water in the mixture of starting ingredients can be approximately 0.75%. In various embodiments for use in the concrete industry, the maximum percentage of total water in the mixture of starting ingredients can be approximately 0.70%. In various embodiments for use in the concrete industry, the maximum percentage of total water in the mixture of starting ingredients can be approximately 0.65%. In various embodiments for use in the concrete industry, the maximum percentage of total water in the mixture of starting ingredients can be approximately 0.60%. In various embodiments for use in the concrete industry, the maximum percentage of total water in the mixture of starting ingredients can be approximately 0.55%. In various embodiments for use in the concrete industry, the maximum percentage of total water in the mixture of starting ingredients can be approximately 0.50%. In various embodiments for use in the concrete industry, the maximum percentage of total water in the mixture of starting ingredients can be approximately 0.45%. In various embodiments for use in the concrete industry, the maximum percentage of total water in the mixture of starting ingredients can be approximately 0.40%. In various embodiments for use in the concrete industry, the maximum percentage of total water in the mixture of starting ingredients can be approximately 0.35%. In various embodiments for use in the concrete industry, the maximum percentage of total water in the mixture of starting ingredients can be approximately 0.30%. For various embodiments designed for use in the concrete industry, the maximum percentage of water used in the starting mixture of raw ingredients can be important, because an excess of water can result in the formation of too many FFAs, which may have a harmful effect on the curing of the concrete.

In various embodiments for the concrete industry, the mixture of raw starting ingredients can include added water that can be approximately 0.25% of the mixture by weight. In various embodiments for the concrete industry, the mixture of raw starting ingredients can include added water that can be a percentage of the mixture in a range of between approximately 0.0% and approximately 1.3%. In various embodiments for use in the concrete industry, the minimum percentage of added water in the mixture of starting ingredients can be approximately 0.0%. In various embodiments for use in the concrete industry, the minimum percentage of added water in the mixture of starting ingredients can be approximately 0.05%. In various embodiments for use in the concrete industry, the minimum percentage of added water in the mixture of starting ingredients can be approximately 0.10%. In various embodiments for use in the concrete industry, the minimum percentage of added water in the mixture of starting ingredients can be approximately 0.15%. In various embodiments for use in the concrete industry, the minimum percentage of added water in the mixture of starting ingredients can be approximately 0.20%. In various embodiments for use in the concrete industry, the minimum percentage of added water in the mixture of starting ingredients can be approximately 0.25%. In various embodiments for use in the concrete industry, the minimum percentage of added water in the mixture of starting ingredients can be approximately 0.30%. In various embodiments for use in the concrete industry, the minimum percentage of added water in the mixture of starting ingredients can be approximately 0.35%. In various embodiments for use in the concrete industry, the minimum percentage of added water in the mixture of starting ingredients can be approximately 0.40%. In various embodiments for use in the concrete industry, the minimum percentage of added water in the mixture of starting ingredients can be approximately 0.45%. In various embodiments for use in the concrete industry, the minimum percentage of added water in the mixture of starting ingredients can be approximately 0.50%. In various embodiments for use in the concrete industry, the minimum percentage of added water in the mixture of starting ingredients can be approximately 0.55%. In various embodiments for use in the concrete industry, the minimum percentage of added water in the mixture of starting ingredients can be approximately 0.60%. In various embodiments for use in the concrete industry, the minimum percentage of added water in the mixture of starting ingredients can be approximately 0.65%. In various embodiments for use in the concrete industry, the minimum percentage of added water in the mixture of starting ingredients can be approximately 0.70%. In various embodiments for use in the concrete industry, the minimum percentage of added water in the mixture of starting ingredients can be approximately 0.75%. In various embodiments for use in the concrete industry, the minimum percentage of added water in the mixture of starting ingredients can be approximately 0.80%. In various embodiments for use in the concrete industry, the minimum percentage of added water in the mixture of starting ingredients can be approximately 0.85%. In various embodiments for use in the concrete industry, the minimum percentage of added water in the mixture of starting ingredients can be approximately 0.90%. In various embodiments for use in the concrete industry, the minimum percentage of added water in the mixture of starting ingredients can be approximately 0.95%. In various embodiments for use in the concrete industry, the minimum percentage of added water in the mixture of starting ingredients can be approximately 1.0%. In various embodiments for use in the concrete industry, the minimum percentage of added water in the mixture of starting ingredients can be approximately 1.05%. In various embodiments for use in the concrete industry, the minimum percentage of added water in the mixture of starting ingredients can be approximately 1.10%. In various embodiments for use in the concrete industry, the minimum percentage of added water in the mixture of starting ingredients can be approximately 1.15%. In various embodiments for use in the concrete industry, the minimum percentage of added water in the mixture of starting ingredients can be approximately 1.20%. In various embodiments for use in the concrete industry, the minimum percentage of added in the mixture of starting ingredients water can be approximately 1.25%.

In various embodiments for use in the concrete industry, the maximum percentage of added water in the mixture of starting ingredients can be approximately 1.3%. In various embodiments for use in the concrete industry, the maximum percentage of added water in the mixture of starting ingredients can be approximately 1.25%. In various embodiments for use in the concrete industry, the maximum percentage of added water in the mixture of starting ingredients can be approximately 1.20%. In various embodiments for use in the concrete industry, the maximum percentage of added water in the mixture of starting ingredients can be approximately 1.15%. In various embodiments for use in the concrete industry, the maximum percentage of added water in the mixture of starting ingredients can be approximately 1.10%. In various embodiments for use in the concrete industry, the maximum percentage of added water in the mixture of starting ingredients can be approximately 1.05%. In various embodiments for use in the concrete industry, the maximum percentage of added water in the mixture of starting ingredients can be approximately 1.0%. In various embodiments for use in the concrete industry, the maximum percentage of added water in the mixture of starting ingredients can be approximately 0.95%. In various embodiments for use in the concrete industry, the maximum percentage of added water in the mixture of starting ingredients can be approximately 0.90%. In various embodiments for use in the concrete industry, the maximum percentage of added water in the mixture of starting ingredients can be approximately 0.85%. In various embodiments for use in the concrete industry, the maximum percentage of added water in the mixture of starting ingredients can be approximately 0.80%. In various embodiments for use in the concrete industry, the maximum percentage of added water in the mixture of starting ingredients can be approximately 0.75%. In various embodiments for use in the concrete industry, the maximum percentage of added water in the mixture of starting ingredients can be approximately 0.70%. In various embodiments for use in the concrete industry, the maximum percentage of added water in the mixture of starting ingredients can be approximately 0.65%. In various embodiments for use in the concrete industry, the maximum percentage of added water in the mixture of starting ingredients can be approximately 0.60%. In various embodiments for use in the concrete industry, the maximum percentage of added water in the mixture of starting ingredients can be approximately 0.55%. In various embodiments for use in the concrete industry, the maximum percentage of added water in the mixture of starting ingredients can be approximately 0.50%. In various embodiments for use in the concrete industry, the maximum percentage of added water in the mixture of starting ingredients can be approximately 0.45%. In various embodiments for use in the concrete industry, the maximum percentage of added water in the mixture of starting ingredients can be approximately 0.40%. In various embodiments for use in the concrete industry, the maximum percentage of added water in the mixture of starting ingredients can be approximately 0.35%. In various embodiments for use in the concrete industry, the maximum percentage of added water in the mixture of starting ingredients can be approximately 0.30%. In various embodiments for use in the concrete industry, the maximum percentage of added water in the mixture of starting ingredients can be approximately 0.25%. In various embodiments for use in the concrete industry, the maximum percentage of added water in the mixture of starting ingredients can be approximately 0.20%. In various embodiments for use in the concrete industry, the maximum percentage of added water in the mixture of starting ingredients can be approximately 0.15%. In various embodiments for use in the concrete industry, the maximum percentage of added water in the mixture of starting ingredients can be approximately 0.10%. In various embodiments for use in the concrete industry, the maximum percentage of added water in the mixture of starting ingredients can be approximately 0.05%.

Various embodiments designed for the concrete industry can also be used in the mining and asphalt industries. However, various embodiments designed for the mining and asphalt industries can be unsuitable for the concrete industries. Various embodiments designed for the mining and asphalt industries may benefit from greater quantities of FFAs in the final products compared to embodiments designed for the concrete industries, at least because the greater quantities of FFAs result in greater quantities of MFAs occurring when the release agent is used on these industries, and the greater quantities of MFAs can improve the release agent's ability to prevent adhesion. These embodiments for the mining and asphalt industries can start with greater quantities of water in the starting mixture of raw ingredients, which can result in greater quantities of FFAs in the final product release agent. It should be clear that a wide range of ratios of starting ingredients is possible due to the range of possible applications, however, in any one application or any one industry, the composition of the mixture of raw starting ingredients can follow a formula that can be based on very precise weight ratios to achieve the best performance for that particular industry. In various embodiments, even the slightest variations of 0.05% water as a starting ingredient can have significant impacts on the performance of the final product for a given industry, while in other embodiments, increased water as a starting ingredient, resulting in increased levels of FFAs in the final product, may be less significant in other industries. In various embodiments for various industries, the maximum allowable total FFAs in the final product release agent can be different for different industries for a variety of reasons, including the possibility that FFAs above a maximum allowable level for a given industry may cause an undesirable weakness or other undesirable effects on the strength of various materials such as concrete, while being well suited for other industries such as asphalt and mining.

In various embodiments designed for use in the mining and asphalt industries, the mixture of raw starting ingredients can include total water that can be a percentage of the mixture of starting ingredients in a range of between approximately 1.3% and approximately 3.3%. In various embodiments for use in the mining and asphalt industries, the minimum percentage of total water in the mixture of starting ingredients can be approximately 1.3%. In various embodiments for use in the mining and asphalt industries, the minimum percentage of total water in the mixture of starting ingredients can be approximately 1.4%. In various embodiments for use in the mining and asphalt industries, the minimum percentage of total water in the mixture of starting ingredients can be approximately 1.5%. In various embodiments for use in the mining and asphalt industries, the minimum percentage of total water in the mixture of starting ingredients can be approximately 1.6%. In various embodiments for use in the mining and asphalt industries, the minimum percentage of total water in the mixture of starting ingredients can be approximately 1.7%. In various embodiments for use in the mining and asphalt industries, the minimum percentage of total water in the mixture of starting ingredients can be approximately 1.8%. In various embodiments for use in the mining and asphalt industries, the minimum percentage of total water in the mixture of starting ingredients can be approximately 1.9%. In various embodiments for use in the mining and asphalt industries, the minimum percentage of total water in the mixture of starting ingredients can be approximately 2.0%. In various embodiments for use in the mining and asphalt industries, the minimum percentage of total water in the mixture of starting ingredients can be approximately 2.1%. In various embodiments for use in the mining and asphalt industries, the minimum percentage of total water in the mixture of starting ingredients can be approximately 2.2%. In various embodiments for use in the mining and asphalt industries, the minimum percentage of total water in the mixture of starting ingredients can be approximately 2.3%. In various embodiments for use in the mining and asphalt industries, the minimum percentage of total water in the mixture of starting ingredients can be approximately 2.4%. In various embodiments for use in the mining and asphalt industries, the minimum percentage of total water in the mixture of starting ingredients can be approximately 2.5%. In various embodiments for use in the mining and asphalt industries, the minimum percentage of total water in the mixture of starting ingredients can be approximately 2.6%. In various embodiments for use in the mining and asphalt industries, the minimum percentage of total water in the mixture of starting ingredients can be approximately 2.7%. In various embodiments for use in the mining and asphalt industries, the minimum percentage of total water in the mixture of starting ingredients can be approximately 2.8%. In various embodiments for use in the mining and asphalt industries, the minimum percentage of total water in the mixture of starting ingredients can be approximately 2.9%. In various embodiments for use in the mining and asphalt industries, the minimum percentage of total water in the mixture of starting ingredients can be approximately 3.0%. In various embodiments for use in the mining and asphalt industries, the minimum percentage of total water in the mixture of starting ingredients can be approximately 3.1%. In various embodiments for use in the mining and asphalt industries, the minimum percentage of total water in the mixture of starting ingredients can be approximately 3.2%.

In various embodiments for use in the mining and asphalt industries, the maximum percentage of total water in the mixture of starting ingredients can be approximately 3.3%. In various embodiments for use in the mining and asphalt industries, the maximum percentage of total water in the mixture of starting ingredients can be approximately 3.2%. In various embodiments for use in the mining and asphalt industries, the maximum percentage of total water in the mixture of starting ingredients can be approximately 3.1%. In various embodiments for use in the mining and asphalt industries, the maximum percentage of total water in the mixture of starting ingredients can be approximately 3.0%. In various embodiments for use in the mining and asphalt industries, the maximum percentage of total water in the mixture of starting ingredients can be approximately 2.9%. In various embodiments for use in the mining and asphalt industries, the maximum percentage of total water in the mixture of starting ingredients can be approximately 2.8%. In various embodiments for use in the mining and asphalt industries, the maximum percentage of total water in the mixture of starting ingredients can be approximately 2.7%. In various embodiments for use in the mining and asphalt industries, the maximum percentage of total water in the mixture of starting ingredients can be approximately 2.6%. In various embodiments for use in the mining and asphalt industries, the maximum percentage of total water in the mixture of starting ingredients can be approximately 2.5%. In various embodiments for use in the mining and asphalt industries, the maximum percentage of total water in the mixture of starting ingredients can be approximately 2.4%. In various embodiments for use in the mining and asphalt industries, the maximum percentage of total water in the mixture of starting ingredients can be approximately 2.3%. In various embodiments for use in the mining and asphalt industries, the maximum percentage of total water in the mixture of starting ingredients can be approximately 2.2%. In various embodiments for use in the mining and asphalt industries, the maximum percentage of total water in the mixture of starting ingredients can be approximately 2.1%. In various embodiments for use in the mining and asphalt industries, the maximum percentage of total water in the mixture of starting ingredients can be approximately 2.0%. In various embodiments for use in the mining and asphalt industries, the maximum percentage of total water in the mixture of starting ingredients can be approximately 1.9%. In various embodiments for use in the mining and asphalt industries, the maximum percentage of total water in the mixture of starting ingredients can be approximately 1.8%. In various embodiments for use in the mining and asphalt industries, the maximum percentage of total water in the mixture of starting ingredients can be approximately 1.7%. In various embodiments for use in the mining and asphalt industries, the maximum percentage of total water in the mixture of starting ingredients can be approximately 1.6%. In various embodiments for use in the mining and asphalt industries, the maximum percentage of total water in the mixture of starting ingredients can be approximately 1.5%. In various embodiments for use in the mining and asphalt industries, the maximum percentage of total water in the mixture of starting ingredients can be approximately 1.4%.

In various embodiments designed for use in the mining and asphalt industries, the mixture of raw starting ingredients can include added water that can be a percentage of the mixture of starting ingredients in a range of between approximately 1.0% and approximately 3.3%. In various embodiments for use in the mining and asphalt industries, the minimum percentage of added water in the mixture of starting ingredients can be approximately 1.0%. In various embodiments for use in the mining and asphalt industries, the minimum percentage of added water in the mixture of starting ingredients can be approximately 1.1%. In various embodiments for use in the mining and asphalt industries, the minimum percentage of added water in the mixture of starting ingredients can be approximately 1.2%. In various embodiments for use in the mining and asphalt industries, the minimum percentage of added water in the mixture of starting ingredients can be approximately 1.3%. In various embodiments for use in the mining and asphalt industries, the minimum percentage of added water in the mixture of starting ingredients can be approximately 1.4%. In various embodiments for use in the mining and asphalt industries, the minimum percentage of added water in the mixture of starting ingredients can be approximately 1.5%. In various embodiments for use in the mining and asphalt industries, the minimum percentage of added water in the mixture of starting ingredients can be approximately 1.6%. In various embodiments for use in the mining and asphalt industries, the minimum percentage of added water in the mixture of starting ingredients can be approximately 1.7%. In various embodiments for use in the mining and asphalt industries, the minimum percentage of added water in the mixture of starting ingredients can be approximately 1.8%. In various embodiments for use in the mining and asphalt industries, the minimum percentage of added water in the mixture of starting ingredients can be approximately 1.9%. In various embodiments for use in the mining and asphalt industries, the minimum percentage of added water in the mixture of starting ingredients can be approximately 2.0%. In various embodiments for use in the mining and asphalt industries, the minimum percentage of added water in the mixture of starting ingredients can be approximately 2.1%. In various embodiments for use in the mining and asphalt industries, the minimum percentage of added water in the mixture of starting ingredients can be approximately 2.2%. In various embodiments for use in the mining and asphalt industries, the minimum percentage of added water in the mixture of starting ingredients can be approximately 2.3%. In various embodiments for use in the mining and asphalt industries, the minimum percentage of added water in the mixture of starting ingredients can be approximately 2.4%. In various embodiments for use in the mining and asphalt industries, the minimum percentage of added water in the mixture of starting ingredients can be approximately 2.5%. In various embodiments for use in the mining and asphalt industries, the minimum percentage of added water in the mixture of starting ingredients can be approximately 2.6%. In various embodiments for use in the mining and asphalt industries, the minimum percentage of added water in the mixture of starting ingredients can be approximately 2.7%. In various embodiments for use in the mining and asphalt industries, the minimum percentage of added water in the mixture of starting ingredients can be approximately 2.8%. In various embodiments for use in the mining and asphalt industries, the minimum percentage of added water in the mixture of starting ingredients can be approximately 2.9%. In various embodiments for use in the mining and asphalt industries, the minimum percentage of added water in the mixture of starting ingredients can be approximately 3.0%. In various embodiments for use in the mining and asphalt industries, the minimum percentage of added water in the mixture of starting ingredients can be approximately 3.1%. In various embodiments for use in the mining and asphalt industries, the minimum percentage of added water in the mixture of starting ingredients can be approximately 3.2%.

In various embodiments for use in the mining and asphalt industries, the maximum percentage of added water in the mixture of starting ingredients can be approximately 3.3%. In various embodiments for use in the mining and asphalt industries, the maximum percentage of added water in the mixture of starting ingredients can be approximately 3.2%. In various embodiments for use in the mining and asphalt industries, the maximum percentage of added water in the mixture of starting ingredients can be approximately 3.1%. In various embodiments for use in the mining and asphalt industries, the maximum percentage of added water in the mixture of starting ingredients can be approximately 3.0%. In various embodiments for use in the mining and asphalt industries, the maximum percentage of added water in the mixture of starting ingredients can be approximately 2.9%. In various embodiments for use in the mining and asphalt industries, the maximum percentage of added water in the mixture of starting ingredients can be approximately 2.8%. In various embodiments for use in the mining and asphalt industries, the maximum percentage of added water in the mixture of starting ingredients can be approximately 2.7%. In various embodiments for use in the mining and asphalt industries, the maximum percentage of added water in the mixture of starting ingredients can be approximately 2.6%. In various embodiments for use in the mining and asphalt industries, the maximum percentage of added water in the mixture of starting ingredients can be approximately 2.5%. In various embodiments for use in the mining and asphalt industries, the maximum percentage of added water in the mixture of starting ingredients can be approximately 2.4%. In various embodiments for use in the mining and asphalt industries, the maximum percentage of added water in the mixture of starting ingredients can be approximately 2.3%. In various embodiments for use in the mining and asphalt industries, the maximum percentage of added water in the mixture of starting ingredients can be approximately 2.2%. In various embodiments for use in the mining and asphalt industries, the maximum percentage of added water in the mixture of starting ingredients can be approximately 2.1%. In various embodiments for use in the mining and asphalt industries, the maximum percentage of added water in the mixture of starting ingredients can be approximately 2.0%. In various embodiments for use in the mining and asphalt industries, the maximum percentage of added water in the mixture of starting ingredients can be approximately 1.9%. In various embodiments for use in the mining and asphalt industries, the maximum percentage of added water in the mixture of starting ingredients can be approximately 1.8%. In various embodiments for use in the mining and asphalt industries, the maximum percentage of added water in the mixture of starting ingredients can be approximately 1.7%. In various embodiments for use in the mining and asphalt industries, the maximum percentage of added water in the mixture of starting ingredients can be approximately 1.6%. In various embodiments for use in the mining and asphalt industries, the maximum percentage of added water in the mixture of starting ingredients can be approximately 1.5%. In various embodiments for use in the mining and asphalt industries, the maximum percentage of added water in the mixture of starting ingredients can be approximately 1.4%. In various embodiments for use in the mining and asphalt industries, the maximum percentage of added water in the mixture of starting ingredients can be approximately 1.3%. In various embodiments for use in the mining and asphalt industries, the maximum percentage of added water in the mixture of starting ingredients can be approximately 1.2%. In various embodiments for use in the mining and asphalt industries, the maximum percentage of added water in the mixture of starting ingredients can be approximately 1.1%.

The percentage of water in the starting mixture of raw ingredients can also be referred to as the percentage of water used as a reagent. The percentage of water used as a reagent can vary in different applications. By way of non-limiting example, different types of concrete may be more or less tolerant to different ranges of FFAs in the final product release agent. Similarly, other industries, and even different applications within the same industry may be more or less tolerant to different ranges of FFAs in the final product release agent. The quantity of water used as a reagent can be tailored to individual industries quickly and easily, and different final products can be produced for a wide variety of different industries that may benefit from different ranges of FFAs in the final product release agent. In various embodiments the added water can be in a range between approximately 0.0% and approximately 3.3%. (It should be clear that added water can be 0.0% if the CDSBO already has sufficient water concentrations for the hydrolysis so that no additional water needs to be added.) In various embodiments, the total water used as a reagent can be in a range between approximately 0.25% and approximately 3.3%. In various embodiments, the maximum water in the starting mixture of raw ingredients can be even higher, with the understanding that additional water may not be completely consumed in hydrolysis, leading to a potentially undesirable effect of having water remaining in the fluid after the hydrolysis process.

In various embodiments, the mixture of raw ingredients can include surfactant that can be approximately 5% by weight of the mixture. Performance and shelf life of the final product material release agent can suffer when the surfactant is less than 5% of the mixture, however it is possible to use as low as 3% surfactant in the mixture, with the understanding that performance and shelf life may suffer as a result of using less than 5%. In various embodiments, the mixture of starting ingredients can include surfactant that can be a percentage of the mixture in a range between approximately 3% and approximately 25% surfactant. In various embodiments, the minimum percentage of surfactant by weight in the mixture of starting ingredients can be approximately 3%. In various embodiments, the minimum percentage of surfactant by weight in the mixture of starting ingredients can be approximately 4%. In various embodiments, the minimum percentage of surfactant by weight in the mixture of starting ingredients can be approximately 5%. In various embodiments, the minimum percentage of surfactant by weight in the mixture of starting ingredients can be approximately 6%. In various embodiments, the minimum percentage of surfactant by weight in the mixture of starting ingredients can be approximately 7%. In various embodiments, the minimum percentage of surfactant by weight in the mixture of starting ingredients can be approximately 8%. In various embodiments, the minimum percentage of surfactant by weight in the mixture of starting ingredients can be approximately 9%. In various embodiments, the minimum percentage of surfactant by weight in the mixture of starting ingredients can be approximately 10%. In various embodiments, the minimum percentage of surfactant by weight in the mixture of starting ingredients can be approximately 15%. In various embodiments, the minimum percentage of surfactant by weight in the mixture of starting ingredients can be approximately 20%.

Higher amounts of surfactant may result in displacement of oil and water that would then reduce the efficiency of formation of FFAs. Higher concentrations of surfactants may also result in increased cost of the release agent as the surfactants are the most expensive ingredient in the release agent of the invention. In various embodiments, the maximum percentage of surfactant by weight in the mixture of starting ingredients can be approximately 25%. In various embodiments, the maximum percentage of surfactant by weight in the mixture of starting ingredients can be approximately 20%. In various embodiments, the maximum percentage of surfactant by weight in the mixture of starting ingredients can be approximately 15%. In various embodiments, the maximum percentage of surfactant by weight in the mixture of starting ingredients can be approximately 10%. In various embodiments, the maximum percentage of surfactant by weight in the mixture of starting ingredients can be approximately 9%. In various embodiments, the maximum percentage of surfactant by weight in the mixture of starting ingredients can be approximately 8%. In various embodiments, the maximum percentage of surfactant by weight in the mixture of starting ingredients can be approximately 7%. In various embodiments, the maximum percentage of surfactant by weight in the mixture of starting ingredients can be approximately 6%. In various embodiments, the maximum percentage of surfactant by weight in the mixture of starting ingredients can be approximately 5%. In various embodiments, the maximum percentage of surfactant by weight in the mixture of starting ingredients can be approximately 4%.

The percentage of oil used as a raw ingredient can be the remainder after the percentages of surfactant and added water have been determined. By way of non-limiting example, in an embodiment that uses 0.25% added water and 5.0% surfactant, the remaining percentage leaves 94.75% oil to be used as a raw ingredient. In various embodiments, the mixture of raw ingredients can include oil that can be approximately 94.75% of the mixture. In various embodiments, the mixture of raw ingredients can include oil that can be a percentage of the mixture in a range between approximately 72% and approximately 97% oil. In various embodiments, the minimum percentage of oil by weight in the mixture of starting ingredients can be approximately 72%. In various embodiments, the minimum percentage of oil by weight in the mixture of starting ingredients can be approximately 75%. In various embodiments, the minimum percentage of oil by weight in the mixture of starting ingredients can be approximately 80%. In various embodiments, the minimum percentage of oil by weight in the mixture of starting ingredients can be approximately 85%. In various embodiments, the minimum percentage of oil by weight in the mixture of starting ingredients can be approximately 90%. In various embodiments, the minimum percentage of oil by weight in the mixture of starting ingredients can be approximately 91%. In various embodiments, the minimum percentage of oil by weight in the mixture of starting ingredients can be approximately 92%. In various embodiments, the minimum percentage of oil by weight in the mixture of starting ingredients can be approximately 93%. In various embodiments, the minimum percentage of oil by weight in the mixture of starting ingredients can be approximately 94%. In various embodiments, the minimum percentage of oil by weight in the mixture of starting ingredients can be approximately 95%. In various embodiments, the minimum percentage of oil by weight in the mixture of starting ingredients can be approximately 96%. In various embodiments, the maximum percentage of oil by weight in the mixture of starting ingredients can be approximately 97%. In various embodiments, the maximum percentage of oil by weight in the mixture of starting ingredients can be approximately 96%. In various embodiments, the maximum percentage of oil by weight in the mixture of starting ingredients can be approximately 95%. In various embodiments, the maximum percentage of oil by weight in the mixture of starting ingredients can be approximately 94%. In various embodiments, the maximum percentage of oil by weight in the mixture of starting ingredients can be approximately 93%. In various embodiments, the maximum percentage of oil by weight in the mixture of starting ingredients can be approximately 92%. In various embodiments, the maximum percentage of oil by weight in the mixture of starting ingredients can be approximately 91%. In various embodiments, the maximum percentage of oil by weight in the mixture of starting ingredients can be approximately 90%. In various embodiments, the maximum percentage of oil by weight in the mixture of starting ingredients can be approximately 85%. In various embodiments, the maximum percentage of oil by weight in the mixture of starting ingredients can be approximately 80%. In various embodiments, the maximum percentage of oil by weight in the mixture of starting ingredients can be approximately 75%.

After the starting ingredients are combined to form the starting mixture of oil, surfactant, and water, the mixture can then be hydrolyzed. Hydrolysis of the mixture can include bringing the mixture of raw starting ingredients to a specific temperature and a specific pressure. Different starting ingredients and different ratios of starting ingredients can have different ideal processing temperatures and pressures. Hydrolysis can be thermodynamically driven to increase reaction rate with increasing temperature. In various embodiments, the mixture should be hydrolyzed at a temperature of approximately 100° F. (37.8° C.). In various embodiments, the mixture should be hydrolyzed at a temperature in a range between approximately 99.5° F. (37.5° C.) and approximately 100.5° F. (38.1° C.). In various embodiments, the mixture should be hydrolyzed at a temperature in a range between approximately 95° F. (35° C.) and approximately 105° F. (40.6° C.). In various embodiments, the mixture should be hydrolyzed at a temperature in a range between approximately 90° F. (32.2° C.) and approximately 120° F. (48.9° C.).

In various embodiments, the minimum temperature for the hydrolysis can be approximately 90° F. (32.2° C.) In various embodiments, the minimum temperature for the hydrolysis can be approximately 95° F. (35° C.). In various embodiments, the minimum temperature for the hydrolysis can be approximately 100° F. (37.8° C.). In various embodiments, the minimum temperature for the hydrolysis can be approximately 105° F. (40.6° C.). In various embodiments, the minimum temperature for the hydrolysis can be approximately 110° F. (43.3° C.). In various embodiments, the minimum temperature for the hydrolysis can be approximately 115° F. (46.1° C.).

In various embodiments, the maximum temperature for the hydrolysis can be approximately 120° F. (48.9° C.). In various embodiments, the maximum temperature for the hydrolysis can be approximately 115° F. (46.1° C.). In various embodiments, the maximum temperature for the hydrolysis can be approximately 110° F. (43.3° C.). In various embodiments, the maximum temperature for the hydrolysis can be approximately 105° F. (40.6° C.). In various embodiments, the maximum temperature for the hydrolysis can be approximately 100° F. (37.8° C.). In various embodiments, the maximum temperature for the hydrolysis can be approximately 95° F. (35° C.).

In various embodiments, the mixture should be hydrolyzed at a pressure of approximately 1800 psi (12.06 MPa). It is important to maintain the pressure for the hydrolysis process at 1800 psi (12.06 MPa), with variations of no more than +/−50 psi (0.344 MPa). Pressures outside of this narrow range can result in failure of the manufacturing process, including incomplete hydrolysis, incomplete emulsion, and/or rapid separation of components. In various embodiments, the mixture should be hydrolyzed at a pressure in a range between approximately 1750 psi (12.06 MPa) and approximately 1850 psi (12.75 MPa). In various embodiments, the mixture should be hydrolyzed at a pressure in a range between approximately 1770 psi (12.20 MPa) and approximately 1830 psi (12.62 MPa). In various embodiments, the minimum pressure for hydrolysis can be approximately 1750 psi (12.06 MPa). In various embodiments, the minimum pressure for hydrolysis can be approximately 1760 psi (12.13 MPa). In various embodiments, the minimum pressure for hydrolysis can be approximately 1770 psi (12.20 MPa). In various embodiments, the minimum pressure for hydrolysis can be approximately 1780 psi (12.27 MPa). In various embodiments, the minimum pressure for hydrolysis can be approximately 1790 psi (12.34 MPa). In various embodiments, the minimum pressure for hydrolysis can be approximately 1800 psi (12.41 MPa). In various embodiments, the minimum pressure for hydrolysis can be approximately 1810 psi 12.48 MPa). In various embodiments, the minimum pressure for hydrolysis can be approximately 1820 psi (12.55 MPa). In various embodiments, the minimum pressure for hydrolysis can be approximately 1830 psi (12.62 MPa). In various embodiments, the minimum pressure for hydrolysis can be approximately 1840 psi (12.68 MPa). In various embodiments, the maximum pressure for hydrolysis can be approximately 1850 psi (12.75 MPa). In various embodiments, the maximum pressure for hydrolysis can be approximately 1840 psi (12.68 MPa). In various embodiments, the maximum pressure for hydrolysis can be approximately 1830 psi (12.62 MPa). In various embodiments, the maximum pressure for hydrolysis can be approximately 1820 psi (12.55 MPa). In various embodiments, the maximum pressure for hydrolysis can be approximately 1810 psi 12.48 MPa). In various embodiments, the maximum pressure for hydrolysis can be approximately 1800 psi (12.41 MPa). In various embodiments, the maximum pressure for hydrolysis can be approximately 1790 psi (12.34 MPa). In various embodiments, the maximum pressure for hydrolysis can be approximately 1780 psi (12.27 MPa). In various embodiments, the maximum pressure for hydrolysis can be approximately 1770 psi (12.20 MPa). In various embodiments, the maximum pressure for hydrolysis can be approximately 1760p si (12.13 MPa).

In various embodiments, the hydrolysis can occur in a liquid whistle class of inline static mixer, also known as a high-pressure homogenizer, as described in U.S. Pat. No. 5,837,272 to Herm, Jr., titled "PROCESS FOR FORMING STABLE GELLED AQUEOUS COMPOSITION" and in U.S. Pat. No. 8,322,910 to Gansmuller, titled "APPARATUS AND METHOD FOR MIXING BY PRODUCING SHEAR AND/OR CAVITATION, AND COMPONENTS FOR APPARATUS", the entire disclosures of which are incorporated herein by reference. As described, the raw starting ingredients can be accelerated through a small orifice into the mixing and/or cavitation chamber where the combined raw materials collide into a knife-like blade in the fluid path creating highly turbulent flow fields and hydrodynamic cavitation which can generate very stable emulsions and/or suspensions. This process using the high-pressure homogenizing equipment operating at the above-mentioned temperatures and pressures can result in total consumption of all the water via induced hydrolysis reactions. The induced hydrolysis and near total consumption of all water in the starting mixture can occur by organic chemical reaction and mechanochemical reaction mechanisms, resulting in increased levels of FFAs that are in an anhydrous nonpolar solution. This anhydrous, nonpolar solution containing increased levels of FFAs can become the final product release agent. In various embodiments, the hydrolysis may not occur in this liquid whistle class of inline static mixer, also known as a high-pressure homogenizer, outside of the temperatures in a range between approximately 90° F. (32.2° C.) and approximately 120° F. (48.9° C.). In various embodiments, the hydrolysis may not occur in this liquid whistle class of inline static mixer, also known as a high-pressure homogenizer, outside of the pressures in a range between approximately 1750 psi (12.06 MPa) and approximately 1850 psi (12.75 MPa).

The process of manufacturing the materials release agent includes inducing hydrolysis of the oil to cause the FAs to be freed and become FFAs. Upon application to an equipment surface, the FFAs freed through this manufacturing process can then combine with the Metals in the materials to form the MFA salts on the surface, and the MFA salts prevent the materials from adhering to surfaces that have been coated with the materials release agent.

Terms such as final product, final fluid, fluid for use in reducing adhesion of material to equipment, materials release agent, release agent, and final product materials release agent can refer to the product that is produced by the hydrolysis of the starting mixture of ingredients. The final product materials release agent can be an anhydrous emulsion, also referred to as an anhydrous stable suspension, that can include oil remainders, FFAs, and a surfactant. The term "oil remainders" refers to what remains of the oil after the partial hydrolysis, which includes non-hydrolyzed triglycerides plus the diglycerides that remain after a portion of the triglycerides have been hydrolyzed, and potentially monoglycerides that can remain after a portion of the diglycerides are hydrolyzed. In the process described herein, a portion of the triglycerides in the starting mixture can be hydrolyzed to produce a mixture of FFAs, diglycerides, and possibly a small amount of monoglycerides. However, only a portion of the starting triglycerides are hydrolyzed. That hydrolyzed portion results in FFAs and diglycerides, and possibly a small amount of monoglycerides, while the unhydrolyzed portion remains as triglycerides. The oil remainders then consist of intact, unhydrolyzed triglycerides along with the diglycerides that remain after the triglycerides are hydrolyzed, and potentially a small amount of monoglycerides that could remain after any hydrolysis of diglycerides. In embodiments where CDSBO is used as a starting ingredient, the oil remainders after the CDSBO has been hydrolyzed can be referred to as CDSBO oil remainders. In embodiments with other oils used as starting ingredients, the oil remainders can be referred to as the starting oil type of oil remainder. It should be clear that the term hydrolysis, as used throughout this document, refers to partial hydrolysis and not intended to be limited to complete hydrolysis of the triglycerides.

After hydrolysis, all of the water has been consumed, and the final product material release agent can be considered anhydrous, or an organic nonpolar fluid. Although a complete reaction is rarely possible in chemistry, approximately 99% to 99.9999% of the water used as a starting raw ingredient can be consumed through the hydrolysis reaction. It should be clear that the final product material release agent described herein is described as anhydrous, however, it is theoretically possible that up to 0.0055% water may remain in the final material release agent. Accordingly, the material release agent is at least 99.99% anhydrous. For the purpose of this disclosure, at least 99.99% anhydrous will be referred to as being anhydrous.

There are a number of benefits to the materials release agent being anhydrous. If there are traces of residual water in the final materials release agent, it will continue to hydrolyze the CDSBO, which can increase the FFA concentration outside of the desired range, and can lower the pH into an unacceptable range. Furthermore, if there is unaccounted for water added to a batch of cement in a cement truck, the added water can compromise the final strength of the cured cement. Furthermore, any water in the material release agent can contribute to the loss of the suspended emulsion resulting in product separation. Furthermore, the fogging or atomizing of the material release agent within a cement truck produces superior consistent concentration and even distribution when the fluid is anhydrous. For at least these reasons, the materials release agent described herein benefits from being anhydrous.

As the water is consumed through hydrolysis, it results in the release of the FFAs. In various embodiments, the increase of the percentage weight of FFAs in the final product material release agent's total composition is proportional to the initial composition percentage weight of the total water used as a raw starting ingredient, including added water and moisture present in the oil. Assuming complete hydrolysis of all water, the ratio of starting water weight to the final weight of FFAs after hydrolysis can be at least partially affected by the molecular weights of the various FAs and the ratios of the different FAs present in a particular starting oil. Releasing heavier FAs, such as Stearic Acid can result in a higher water/FFA conversion ratio by weight than the release of lighter FFAs, such as Linolenic Acid. The ratio of the percentage by weight of water as a starting ingredient to the percentage by weight of the FFAs in the final product can be referred to as the water/FFA conversion ratio. It should be clear that the water/FFA weight conversion ratio can be affected by various factors such as the weight of the FFAs. The number of Moles of FAs Freed through the hydrolysis reaction can be equal to the number of Moles of water in the starting mixture, based on a successful 100% complete reaction being achieved, because the stoichiometric balanced chemical reaction is a mole ratio of 1:1. It is worth noting the molecular weights (g/mol) for reactant ($H_2O$) and reaction product (FFAs) are significantly different as water is composed of 3 atoms and has a molecular weight of approximately 18 g/mol and the primary FFAs typically found in CDSBO can have approximately 52 atoms + or −, and as a non-limiting example, in one embodiment can have an exemplary molecular weight of approximately 280.44 g/mol, depending on the FA chain length.

By way of non-limiting example, a raw material mixture containing 0.25% total water as the limiting reagent and an excess of the triglyceride shown in FIG. 1 can result in a FFA concentration of approximately 2% by weight in the final product material release agent. This 2% FFAs by weight includes the 0.6% FFAs that may be present in the oil from the manufacturer plus the FFAs that were freed by the hydrolysis reaction with the 0.25% total water. In various embodiments for the concrete industry, the final product material release agent can have FFAs as a percentage by weight of the material release agent in a range between approximately 2% and approximately 18%.

In various embodiments for use in the concrete industry, the minimum percentage by weight of FFAs in the release agent can be approximately 2.0%. In various embodiments for use in the concrete industry, the minimum percentage by weight of FFAs in the release agent can be approximately 2.5%. In various embodiments for use in the concrete industry, the minimum percentage by weight of FFAs in the release agent can be approximately 3.0%. In various embodiments for use in the concrete industry, the minimum percentage by weight of FFAs in the release agent can be approximately 3.5%. In various embodiments for use in the concrete industry, the minimum percentage by weight of FFAs in the release agent can be approximately 4.0%. In various embodiments for use in the concrete industry, the minimum percentage by weight of FFAs in the release agent can be approximately 4.2%. In various embodiments for use in the concrete industry, the minimum percentage by weight of FFAs in the release agent can be approximately 4.5%. In various embodiments for use in the concrete industry, the minimum percentage by weight of FFAs in the release agent can be approximately 5.0%. In various embodiments for use in the concrete industry, the minimum percentage by weight of FFAs in the release agent can be approximately 5.5%. In various embodiments for use in the concrete industry, the minimum percentage by weight of FFAs in the release agent can be approximately 6.0%. In various embodiments for use in the concrete industry, the minimum percentage by weight of FFAs in the release agent can be approximately 7%. In various embodiments for use in the concrete industry, the minimum percentage by weight of FFAs in the release agent can be approximately 8%. In various embodiments for use in the concrete industry, the minimum percentage by weight of FFAs in the release agent can be approximately 9%. In various embodiments for use in the concrete industry, the minimum percentage by weight of FFAs in the release agent can be approximately 10%. In various embodiments for use in the concrete industry, the minimum percentage by weight of FFAs in the release agent can be approximately 15%. In various embodiments for use in the concrete industry, the minimum percentage by weight of FFAs in the release agent can be approximately 16%. In various embodiments for use in the concrete industry, the minimum percentage by weight of FFAs in the release agent can be approximately 17%.

In various embodiments for use in the concrete industry, the maximum percentage by weight of FFAs in the release agent can be approximately 18%. In various embodiments for use in the concrete industry, the maximum percentage by weight of FFAs in the release agent can be approximately 17%. In various embodiments for use in the concrete industry, the maximum percentage by weight of FFAs in the release agent can be approximately 16%. In various embodiments for use in the concrete industry, the maximum percentage by weight of FFAs in the release agent can be approximately 15%. In various embodiments for use in the concrete industry, the maximum percentage by weight of FFAs in the release agent can be approximately 10%. In various embodiments for use in the concrete industry, the maximum percentage by weight of FFAs in the release agent can be approximately 9%. In various embodiments for use in the concrete industry, the maximum percentage by weight of FFAs in the release agent can be approximately 8%. In various embodiments for use in the concrete industry, the maximum percentage by weight of FFAs in the release agent can be approximately 7%. In various embodiments for use in the concrete industry, the maximum percentage by weight of FFAs in the release agent can be approximately 6.0%. In various embodiments for use in the concrete industry, the maximum percentage by weight of FFAs in the release agent can be approximately 5.5%. In various embodiments for use in the concrete industry, the maximum percentage by weight of FFAs in the release agent can be approximately 5.0%. In various embodiments for use in the concrete industry, the maximum percentage by weight of FFAs in the release agent can be approximately 4.5%. In various embodiments for use in the concrete industry, the maximum percentage by weight of FFAs in the release agent can be approximately 4.0%. In various embodiments for use in the concrete industry, the maximum percentage by weight of FFAs in the release agent can be approximately 3.5%. In various embodiments for use in the concrete industry, the maximum percentage by weight of FFAs in the release agent can be approximately 3.0%. In various embodiments for use in the concrete industry, the maximum percentage by weight of FFAs in the release agent can be approximately 2.5%.

In various embodiments for industries such as mining and asphalt, the final product material release agent can have FFAs as a percentage by weight of the material release agent in a range between approximately 17.7% and approximately 35.2%. In various embodiments for industries such as mining and asphalt, the minimum percentage by weight of FFAs in the release agent can be approximately 17.5%. In various embodiments for industries such as mining and asphalt, the minimum percentage by weight of FFAs in the release agent can be approximately 18%. In various embodiments for industries such as mining and asphalt, the minimum percentage by weight of FFAs in the release agent can be approximately 19%. In various embodiments for industries such as mining and asphalt, the minimum percentage by weight of FFAs in the release agent can be approximately 20%. In various embodiments for industries such as mining and asphalt, the minimum percentage by weight of FFAs in the release agent can be approximately 25%. In various embodiments for industries such as mining and asphalt, the minimum percentage by weight of FFAs in the release agent can be approximately 30%. In various embodiments for industries such as mining and asphalt, the minimum percentage by weight of FFAs in the release agent can be approximately 35%.

In various embodiments for industries such as mining and asphalt, the maximum percentage by weight of FFAs in the release agent can be approximately 35%. In various embodiments for industries such as mining and asphalt, the maximum percentage by weight of FFAs in the release agent can be approximately 30%. In various embodiments for industries such as mining and asphalt, the maximum percentage by weight of FFAs in the release agent can be approximately 25%. In various embodiments for industries such as mining and asphalt, the maximum percentage by weight of FFAs in the release agent can be approximately 20%. In various embodiments for industries such as mining and asphalt, the maximum percentage by weight of FFAs in the release agent can be approximately 19%. In various embodiments for industries such as mining and asphalt, the maximum percentage by weight of FFAs in the release agent can be approximately 18%.

By way of non-limiting example, as noted above, different types of concrete may be more or less tolerant to different ranges of FFAs in the final product release agent. Similarly, other industries, and even different applications within the same industry may be more or less tolerant to different ranges of FFAs in the final product release agent. The quantity of FFAs in the release agent can be tailored to individual industries quickly and easily, and different embodiments of material release agents can be produced for a wide variety of different industries that may benefit from different ranges of FFAs in the final product release agent. In various embodiments the percentage by weight of FFAs in the final product material release agent can be in a range between approximately 2% and approximately 35%.

In addition to the FFAs, the final product material release agent can include surfactant in a percentage by weight of between approximately 3% and approximately 25%. A small amount of odorant and/or colorant can also be included in the final material release agent. The material release agent can also include non-hydrolyzed triglycerides and partially hydrolyzed triglycerides, also referred to as the oil remainder. The non-hydrolyzed triglycerides and the partially hydrolyzed triglycerides can have a combined percentage by weight proportional to the completed percentage of the hydrolysis reactions.

In various embodiments, the combined percentage by weight of the non-hydrolyzed triglycerides and the partially hydrolyzed triglycerides, also known as the percentage by weight of the oil remainders, can be 100% minus the percentage by weight of the FFAs and the percentage by weight of the surfactant, that is to say, the combined percentage by weight of the oil remainders can be complimentary to the percentage by weight of the FFAs and the percentage by weight of the surfactant. The oil remainders, the FFAs, and the surfactant can make up 100% of the materials release agent.

In various embodiments, the combined percentage by weight of the oil remainders can be 100% minus the percentage by weight of the FFAs, the percentage by weight of the surfactant, and the percentage by weight of any odorant, and/or colorant, which is to say the combined percentage by weight of the oil remainders can be complimentary to the percentage by weight of the FFAs, the percentage by weight of the surfactant, and the percentage by weight of any odorant and/or colorant. The oil remainders, the FFAs, the surfactant, and any colorant and/or odorant can make up 100% of the materials release agent In embodiments with colorants and/or odorants, the combined percentage by weight of the non-hydrolyzed triglycerides and the partially hydrolyzed triglycerides, also known as the percentage by weight of the oil remainders, can be 95% minus the percentage by weight of the FFAs and the percentage by weight of the surfactant. The combined percentage by weight of the oil remainders, the FFAs, and the surfactant can be at least 95%. The combined percentage by weight of the oil remainders, the FFAs, and the surfactant can be at least 96%. The combined percentage by weight of the oil remainders, the FFAs, and the surfactant can be at least 97%. The combined percentage by weight of the oil remainders, the FFAs, and the surfactant can be at least 98%. The combined percentage by weight of the oil remainders, the FFAs, and the surfactant can be at least 99%.

The percentage by weight of the oil remainders can be in a range between approximately 60% and approximately 95%.

The amount of water remaining in the anhydrous final product material release agent after hydrolysis can be in a range between approximately 0% and approximately 0.01%. The amount of water remaining in the anhydrous final product material release agent after hydrolysis can be in a range between 0% and approximately 0.001%.

The hydrolysis process, including the above-described temperatures, pressures, and patented process equipment referenced and described above result in a super-emulsion fluid that can have a stable shelf life of 24 months or longer. The hydrolyzed crude degummed soybean oil (or other natural oil) and the surfactant dispersing agent maintain the suspension of the freed fatty acids by maintaining the separation of the individual fatty acid microdroplets through dispersion and prevents their settling or agglomerating which results in superior product consistency and significantly extended shelf-life. This phenomenon is how the super emulsion is established.

In addition to the increased presence of the FFAs that are freed through the hydrolysis process, and in addition to the shelf-stable nature of this super-emulsion fluid, the final product material release agent has a number of properties that are beneficial to materials industries such as cement, asphalt, and mining industries. Various physical and chemical properties of the final product material release agent are described below in Table 1.

TABLE 1

| Physical and chemical properties of the product: | |
|---|---|
| Boiling Point | >318° F. (>150° C.) |
| Freezing Point | 24.8° F. (−4° C.) |
| pH | 6.8 |
| Viscosity (Dynamic) | 52cP-55cP at 75° F. (23.9° C.) |
| Density: | 7.55 lbs/gal-7.60 lbs/gal at 75° F. (0.905 g/mL and 0.910 g/mL at 23.9° C.) |

The physical properties shown in Table 1 illustrate various benefits of the present material release agent. Because the product is an oil-based emulsion, it is capable of being used in the harsh environments often associated with the mining and material processing industries. With a freezing point lower than water, the fluid is better able to withstand colder weather conditions without freezing than would a water-based product. This is particularly useful in year-round operations where sub-freezing temperatures are common. Conversely, the product's high boiling point also lends itself to use in extreme high temperature environments that are also often associated with mining and material processing. This is particularly true in processing operations where ore is heated at some point during processing, or when concrete is dehydrated for recycling. Where a water-based product would boil away and be useless, the present product is able to withstand these increased temperatures and continue to function as desired. The viscosity allows the product to be fogged or atomized onto a surface and be evenly distributed across the surface, while also allowing it to remain in place and not be easily washed away when exposed to water or friction.

Similarly, because the product is based on natural plant-based oils, the pH is almost neutral, but faintly acidic because the FFAs result in a pH value that is slightly on the acidic side of the neutral value (7) on the pH scale. In various embodiments, depending on the percentage by weight of the FFAs, the pH of the material release agent can be in a range between approximately 6 and approximately 6.8. In various embodiments, and particularly for embodiments used by the concrete industry, the pH can be in a range between approximately 6.4 and approximately 6.8. The compressive strength of cured concrete can be catastrophically weakened through exposure to acidic conditions, so the pH of the materials release agent must not fall below the 6.0, and preferably not below 6.4. Furthermore, a pH in a range between approximately 6.0 and 6.8 ensures that the FFAs remain free and that they MFA salt formation can take place, so that the materials release agent functions as intended. The materials release agent should not be diluted, and certainly should not be diluted with any product that would lower the pH outside of the acceptable range of approximately 6.0 to approximately 6.8.

The materials release agent is non-toxic and safe for prolonged contact with humans. It is made from natural plant-based oils, it is non-volatile, there are no volatile organic compounds, and the pH is in a safe range between approximately 6 and approximately 6.8. Accordingly, where the product might come into contact with workers there are no known negative effects. Likewise, the product in this preferred embodiment can be 99.5% biodegradable, which is advantageous to waste processing and limits remediation requirements for product release/spills. The present product being a super emulsion is also far less susceptible to dissociation than that of all prior art. This stability drastically improves the longevity of the product, and coupled with the thermal stability reduces the storage requirements of the fluid. In various embodiments the material release agent can be shelf stable for 2+ years.

The materials release agent can be a fluid mixture that can be nonpolar and characterized as an organic phase liquid or oily fluid which is hydrophobic and not miscible with water or an aqueous phase liquid. The materials release agent can be referred to as hydrophobic and water insoluble.

In various embodiments more than 90% by weight of the materials release agent can be a combination of naturally occurring long-chained tri-esters (C46-056), also referred to as triglycerides, that can be dominantly cis-polyunsaturated and cis-monounsaturated, along with the hydrolysis product of the triglycerides, including FFAs and hydrolyzed triglycerides. The combination of these triglycerides, FFAs, and hydrolyzed triglycerides can be more than 90% by weight of the materials release agent, with another 5% or more being a surfactant, also referred to as a disbursing emulsifier. In various embodiments, the surfactant can be a specific disbursing emulsifier known by the IUPAC name "2-[octa (oxyethylene)]-α-(2-proplyheptyl)-ω-hydroxy" (chemical formula $C_{26}H_{54}O_9$). This can be eight moles of an ethylene oxide polymer with the propyl group branching off the secondary Carbon of the base heptane alcohol as the polyethoxylate chain is positioned between the terminal hydroxyl group and the primary carbon of the heptane chain. The surfactant can be a polyether chained branched primary alcohol. The surfactant can be an alkoxylated beta branched alcohol with X moles of alkoxide. The surfactant can be dominantly hydrophobic or lipophilic, but a tertiary hydroxyl group at the end of the molecule can elicit some amphipathic characteristics. The tertiary hydroxyl group at the end of the molecule can trap/clench the free fatty acids and prevent them from separating or settling out of the mixture, thereby maintaining a consistent suspended emulsion. The surfactant molecule can also trap any miniscule amount of water in the material release agent, such as water that may be absorbed from the environment.

The materials release agent can create a MFA salt coating on the surfaces of various equipment. The MFA salts can be formed through various chemical reactions. The chemical reaction for formation of the MFA salts can take place by at least two distinct mechanisms: a 'direct reaction' or a 'precipitation reaction.' The direct reaction mechanism is the primary or most common reaction that takes place forming the MFA salts when utilizing the materials release agent in the cement, mining, and asphalt industries. Both reactions are explained below.

Direct Reaction

In a direct reaction, fatty acids are neutralized to yield a specific salt of fatty acids as cation sources such as oxides (magnesium or calcium oxide) or hydroxides (sodium-, potassium-, magnesium- or calcium hydroxide) can be potential reactants. A direct reaction can follow this general equation:

$$\text{fatty acid}+\text{Metal oxide/hydroxide}\rightarrow\text{MFA salt}+\text{water}$$

Precipitation Reaction

A precipitation reaction consists of two consecutive steps. In a first step, an intermediate MFA salt (typically a fatty acid sodium salt) is produced by the reaction of the fatty acids with aqueous sodium hydroxide.

$$\text{fatty acid}+\text{NaOH}\rightarrow\text{fatty acid sodium salt}+\text{water} \qquad \text{Step 1:}$$

In the second step, a MFA salt is precipitated by a reaction of the fatty acid sodium salt (the intermediate MFA) with a divalent metal cation.

$$2(\text{fatty acid sodium salt})+X^{2+}\rightarrow X(\text{fatty acid})_2+2Na^{+} \qquad \text{Step 2:}$$

$X^{2+}$: being $Ca^{2+}$ or $Mg^{2+}$ and X(fatty acid) 2: being the MFA salt product of Step 2.

The final resulting MFA salt produced by either of the two distinct reaction mechanisms precipitates becoming the thin film barrier explained above.

The material release agent described herein can be applied to various pieces of equipment in several ways. Small pieces of equipment, such as a shovel, can be dipped in the release agent, and the release agent can also be sprayed on equipment of almost any size. It can be sprayed on equipment ranging from boots to large-scale material hauling trucks to the inside of cement mixers. In an embodiment, a mist spraying and/or an atomizing fogging tool can be used to coat various equipment, including the inside of a cement mixer truck with a thin film of the material release agent. An example of one type of equipment used for this process is described in U.S. patent Ser. No. 11/090,700 to Camell, titled SYSTEM FOR SPRAYING THE INTERIOR OF A CONTAINER, the entire disclosure of which is incorporated herein by reference. Another example of an application tool can be a handheld or backpack mounted atomizing fogger.

Once properly applied using the applicable equipment or method to achieve a uniform thin film coating on the entire surface area inside a cement truck drum for example, the surfaces of the inside of the drum of the cement truck are now protected. The material release agent will prevent the buildup of cement on the inside surfaces of the drum. Regardless of the number of loads hauled per day, the material release agent can be applied one time per day and can protect the equipment for the entire working day.

Figure 2:
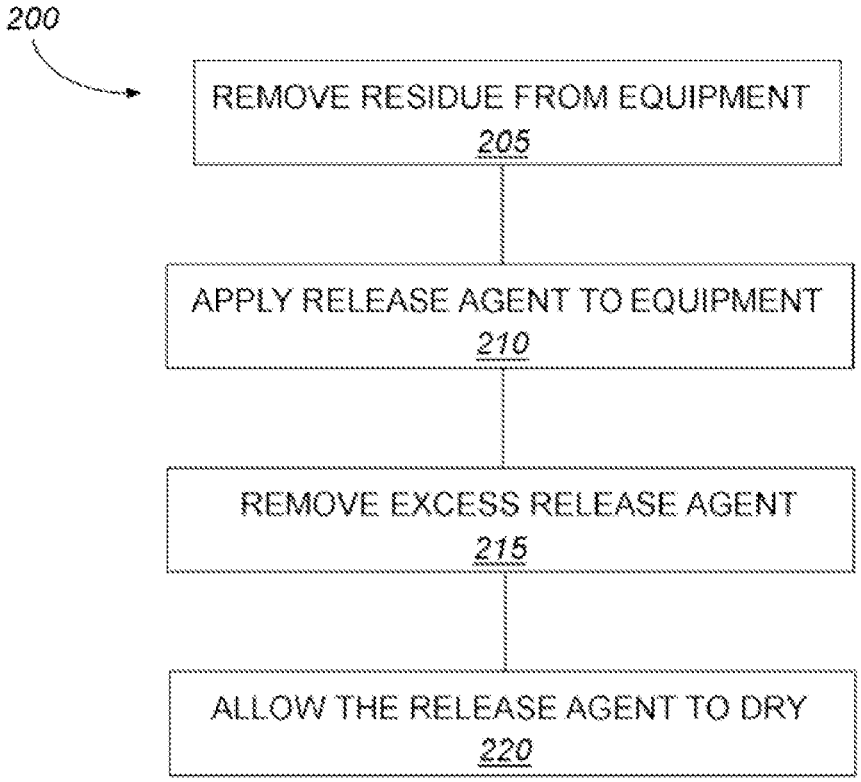
FIG. 2 shows a method of applying the materials release agent to various pieces of equipment used in the cement industry.

The materials release agent can also be applied to any number of other materials-related tools or other equipment. FIG. 2 shows a method 200 of applying the materials release agent to various pieces of equipment. At box 205, a user can be instructed to remove any excess residue, debris, and/or buildup from the equipment. Equipment can include hand tools, boots, large haul trucks, the inside of a concrete mixing truck, or any other equipment. The residue, debris, and/or buildup can be removed with a stream of water, mechanical force, or any means necessary. Water can be used and will not interfere with the effectiveness of the release agent. This cleaning can be a final cleaning at the end of the work day. At box 210, after the final cleaning, and preferably with the equipment still wet from the stream of water but free of standing water, a user can be instructed to apply the release agent to various surfaces of the container, mixer, tool, truck bed, concrete forms, and/or other pieces of equipment as a preventative maintenance action. A thin layer film/sheen of release agent on the surface is sufficient. The non-toxic release agent can be applied in any number of ways, including, for example, the use of a rag that has been dampened with the release agent. In various embodiments, the user can be instructed to use a fogger or atomizer type of sprayer. Preferably the release agent is applied to a wet or damp surface, however, the material release agent can be applied to dry surfaces as well. At box 215, the user can be instructed to wipe or brush away any excess release agent. In various embodiments where the release agent is applied to the inside surfaces of different pieces of equipment, or to large pieces of equipment, wiping or brushing may be unnecessary. In various embodiments where the material release agent is applied to the inner surfaces of a concrete mixing truck, the mixer can be left turning for several minutes to allow the material release agent to coat all surfaces and allow any excess release agent to run off. At box 220, the user can be instructed to allow the release agent to dry for approximately 8-12 hours. In various embodiments, the user can be instructed to position tools/forms vertically so that any excess fluid can drain off of the equipment leaving a uniform thin film of release agent.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, in various embodiments, corn oil can be used as a starting ingredient oil. Also, as used herein, various directional and orientational terms (and grammatical variations thereof) such as "vertical", "horizontal", "up", "down", "bottom", "top", "side", "front", "rear", "left", "right", "forward", "rearward", and the like, are used only as relative conventions and not as absolute orientations with respect to a fixed coordinate system, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances (e. g., 1-5%) of the system. Accordingly, this description is meant to be taken only by way of example, and not to otherwise limit the scope of this invention.

What is claimed is:

1. A material release agent for use in reducing adhesion of material to equipment, the material release agent comprising:

Free Fatty Acids (FFAs) in a percentage by weight in a range of approximately 2% to approximately 17%;

surfactant in a percentage by weight in a range of approximately 3% to approximately 25%; and oil remainders in a percentage by weight of approximately 60% to approximately 94%, wherein the percentage by weight of the FFAs, the surfactant, and the oil remainders is at least 95%.

2. The material release agent of claim 1, wherein the material release agent is immiscible with water.

3. The material release agent of claim 1, wherein the material release agent is anhydrous.

4. The material release agent of claim 1, wherein the materials release agent has a freezing point lower than 25° F. (−3.9° C.).

5. The material release agent of claim 1, wherein the surfactant is in a percentage by weight of approximately 5% to approximately 10%.

6. The material release agent of claim 1, wherein the percentage by weight of the FFAs, the surfactant, and the oil remainders is at least 99%.

7. The material release agent of claim 1, wherein the materials release agent has a viscosity between approximately 52 cP and approximately 55 cP at 75° F. (23.90° C.).

8. The material release agent of claim 1, wherein the materials release agent has a density between 7.55 lbs/gal (0.905 g/mL) and 7.60 lbs/gal (0.910 g/mL) 75° F. (23.9° C.).

9. The material release agent of claim 1, wherein the materials release agent is water insoluble.

10. The material release agent of claim 1, wherein the materials release agent is free of phosphorus, nitrogen, phospholipids, amino acids, oxides, benzenes, triester phosphates, amines, inorganic acids, petroleum lubricants, synthetic oils, alkyl ether carboxylic acid, polyethylene terephthalic acid, phosphoric acid esters, neutralizing agents, phosphate esters, amino alcohols, phosphate esters, amino alcohols, phosphate esters, polyalphaolefins, inorganic acids, inorganic bases, and antioxidants.

11. A method for protecting a surface from material adhesion, the process comprising coating the surface with a material release agent, wherein the material release agent comprises:

oil remainders in a percentage in a range of approximately 60% to approximately 94%;

surfactant in a percentage in a range of approximately 3% to approximately 25%; and Free Fatty Acids (FFAs) in a percentage by weight in a range of approximately 2% to approximately 17%, wherein the percentage by weight of the FFAs, the surfactant, and the oil remainders is at least 95%.

12. A material release agent for use in reducing adhesion of material to equipment, the material release agent comprising:

Free Fatty Acids (FFAs) in a percentage by weight in a range of approximately 2% to approximately 17%;

surfactant in a percentage by weight in a range of approximately 3% to approximately 25%; and oil remainders in a percentage by weight of approximately 60% to approximately 94%, wherein the material release agent is free of additional components which increase the polarity of the material release agent.

13. The material release agent of claim 12, wherein the material release agent is anhydrous.

14. The material release agent of claim 12, wherein the materials release agent has a freezing point lower than 25° F. (−3.9° C.).

15. The material release agent of claim 12, wherein the surfactant is in a percentage by weight of approximately 5% to approximately 10%.

16. The material release agent of claim 12, wherein the percentage by weight of the FFAs, the surfactant, and the oil remainders is at least 95%.

17. The material release agent of claim 12, wherein the percentage by weight of the FFAs, the surfactant, and the oil remainders is at least 99%.

18. The material release agent of claim 12, wherein the materials release agent has a viscosity between approximately 52 cP and approximately 55 cP at 75° F. (23.9° C.).

19. The material release agent of claim 12, wherein the materials release agent has a density between 7.55 lbs/gal (0.905 g/mL) and 7.60 lbs/gal (0.910 g/mL) 75° F. (23.90° C.).

20. The material release agent of claim 12, wherein the materials release agent is free of phosphorus, nitrogen, phospholipids, amino acids, oxides, benzenes, triester phosphates, amines, inorganic acids, petroleum lubricants, synthetic oils, alkyl ether carboxylic acid, polyethylene terephthalic acid, phosphoric acid esters, neutralizing agents, phosphate esters, amino alcohols, phosphate esters, amino alcohols, phosphate esters, polyalphaolefins, inorganic acids, inorganic bases, and antioxidants.

* * * * *